US011613121B2

(12) United States Patent
Takabe

(10) Patent No.: US 11,613,121 B2
(45) Date of Patent: Mar. 28, 2023

(54) LIQUID DISCHARGE HEAD, LIQUID DISCHARGE APPARATUS, AND ACTUATOR

(71) Applicant: SEIKO EPSON CORPORATION, Tokyo (JP)

(72) Inventor: Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 17/208,234

(22) Filed: Mar. 22, 2021

(65) Prior Publication Data

US 2021/0300040 A1 Sep. 30, 2021

(30) Foreign Application Priority Data

Mar. 25, 2020 (JP) ..... JP2020-053956

(51) Int. Cl.
*B41J 2/14* (2006.01)

(52) U.S. Cl.
CPC ..... *B41J 2/14233* (2013.01); *B41J 2/14201* (2013.01); *B41J 2/14274* (2013.01); *B41J 2002/14241* (2013.01); *B41J 2002/14491* (2013.01); *B41J 2202/11* (2013.01)

(58) Field of Classification Search
CPC ..... B41J 2/14233; B41J 2/14201; B41J 2/14274; B41J 2002/14241; B41J 2002/14491; B41J 2202/11
See application file for complete search history.

(56) References Cited

U.S. PATENT DOCUMENTS

| | | | | |
|---|---|---|---|---|
| 9,132,637 | B2 * | 9/2015 | Hirai | B41J 2/14274 |
| 10,000,061 | B2 * | 6/2018 | Naganuma | H01L 41/332 |
| 2013/0208056 | A1 | 8/2013 | Hirai et al. | |
| 2015/0231883 | A1 | 8/2015 | Hirai et al. | |
| 2016/0067967 | A1 | 3/2016 | Naganuma et al. | |

FOREIGN PATENT DOCUMENTS

| | | | |
|---|---|---|---|
| JP | 2013-169061 | A | 8/2013 |
| JP | 2015-171809 | A | 10/2015 |
| JP | 2016-058467 | A | 4/2016 |

* cited by examiner

*Primary Examiner* — Geoffrey S Mruk
(74) *Attorney, Agent, or Firm* — Workman Nydegger

(57) ABSTRACT

A liquid discharge head that includes piezoelectric elements, a pressure chamber plate defining pressure chambers corresponding to the piezoelectric elements, and a vibrating plate disposed between the piezoelectric elements and the pressure chamber plate is provided. In the liquid discharge head, the vibrating plate has, in a first position and a second position, a first portion and a second portion that is away from the end of the pressure chamber than the first portion in a first direction and has a thickness different from a thickness of the first portion. In the first position, a width of the second portion in the first direction is a first width, and in the second position, a width of the second portion in the first direction is a second width that is less than the first width.

16 Claims, 14 Drawing Sheets

LIQUID DISCHARGE HEAD, LIQUID DISCHARGE APPARATUS, AND ACTUATOR

The present application is based on, and claims priority from JP Application Serial Number 2020-053956, filed Mar. 25, 2020, the disclosure of which is hereby incorporated by reference herein in its entirety.

BACKGROUND

1. Technical Field

The present disclosure relates to a liquid discharge head, a liquid discharge apparatus, and an actuator.

2. Related Art

A liquid discharge head is disclosed in JP-A-2016-58467 that has a vibrating plate, piezoelectric elements, pressure chambers that are arranged side by side, and nozzles that communicate with the pressure chambers. The liquid discharge head can be used, for example, in liquid discharge apparatuses such as printers. The liquid discharge head discharges a liquid such as an ink supplied into the pressure chambers from the nozzles by deforming the piezoelectric elements to vibrate the vibrating plate to change the volume of the pressure chambers.

The inventors have found that such liquid ejecting heads as in JP-A-2016-58467 can increase the efficiency of volume change in pressure chambers and the durability of vibrators with a step height between a portion near an end of a pressure chamber and a central portion that is away from the end of the pressure chamber in a vibrating plate. The inventors have also found that such step height provided in the vibrating plate in regions near ends of the individual pressure chambers in the long-side direction may cause stress concentration on the regions near the end portions due to vibration, leading to damage such as cracks.

SUMMARY

According to a first aspect of the present disclosure, a liquid discharge head that includes piezoelectric elements, a pressure chamber plate having pressure chambers corresponding to the piezoelectric elements, and a vibrating plate disposed between the piezoelectric elements and the pressure chamber plate is provided. In the liquid discharge head, when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion. In the first position, a width of the second portion in the first direction is a first width, and in the second position, a width of the second portion in the first direction is a second width that is less than the first width.

According to a second aspect of the present disclosure, a liquid discharge apparatus is provided. The liquid discharge apparatus includes the liquid discharge head according to the first aspect, and a controller configured to control the discharge operation of the liquid discharge head.

According to a third aspect of the present disclosure, an actuator that includes piezoelectric elements, and a vibrating plate disposed between pressure chambers corresponding to the piezoelectric elements and the piezoelectric elements is provided. In the actuator, when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion. In the first position, a width of the second portion in the first direction is a first width, and in the second position, a width of the second portion in the first direction is a second width that is less than the first width.

DESCRIPTION OF EXEMPLARY EMBODIMENTS

A. First Embodiment

Figure 1:
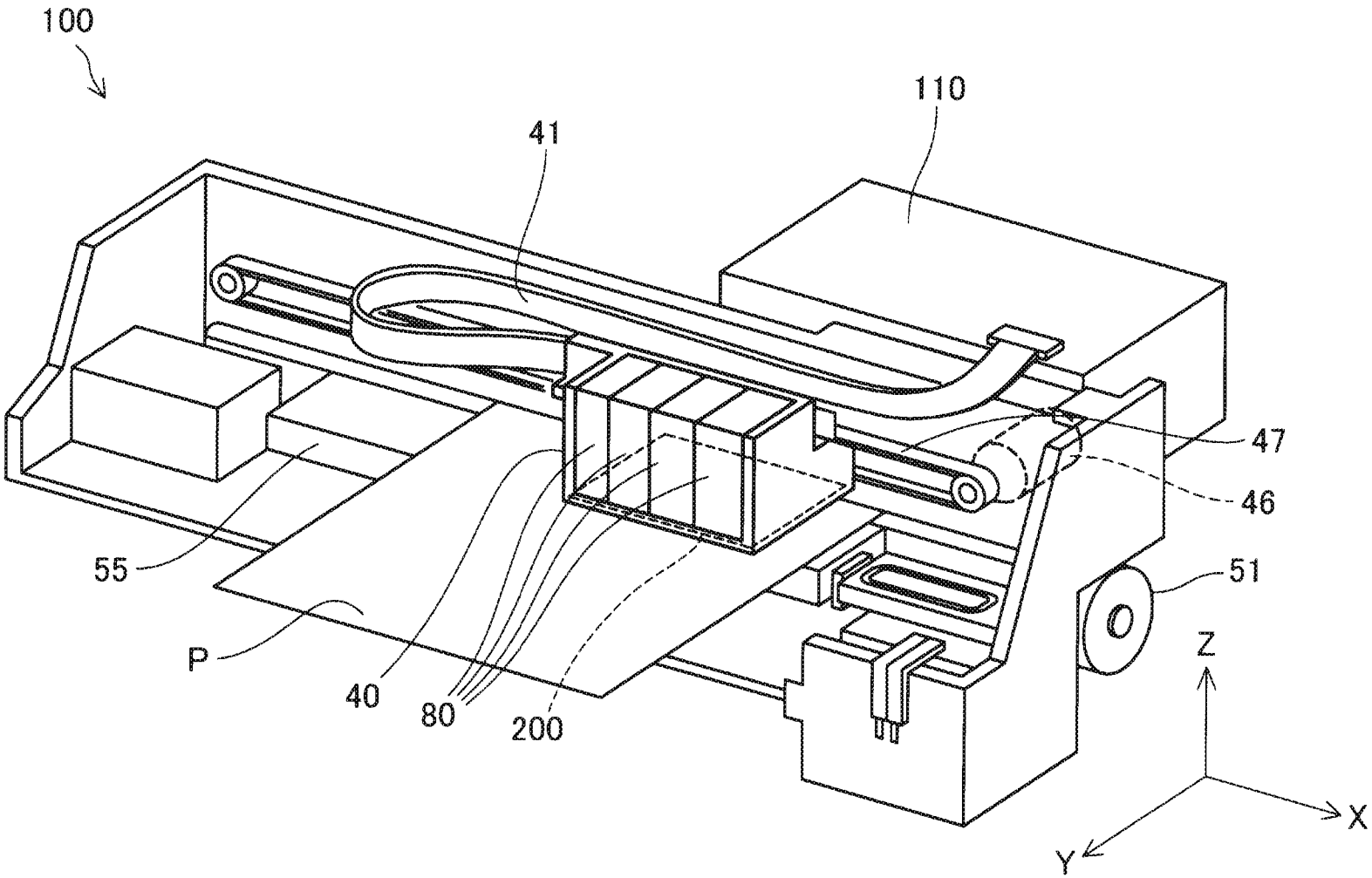
FIG. 1 illustrates a schematic structure of a liquid discharge apparatus that includes a liquid discharge head according to a first embodiment.

FIG. 1 illustrates a schematic structure of a liquid discharge apparatus 100 that includes a liquid discharge head 200 according to a first embodiment. In FIG. 1, respective arrows represent X, Y, and Z directions that are orthogonal to each other. The X direction, the Y direction, and the Z direction respectively denote directions along an X-axis, a Y-axis, and a Z-axis, which are three spatial axes orthogonal to each other, and have directions on one side and the other side along the X-axis, the Y-axis, and the Z-axis respectively. More specifically, positive directions along the X-axis, the Y-axis, and the Z-axis correspond to a +X direction, a +Y direction, and a +Z direction respectively, and minus directions along the X-axis, the Y-axis, and the Z-axis correspond to a −X direction, a −Y direction, and a −Z direction respectively. A plane in the X direction and the Y direction may be referred to as an XY plane, a plane in the X direction and the Z direction may be referred to as an XZ plane, and a plane in the Y direction and the Z direction may be referred to as a YZ plane. In FIG. 1, the X-axis and the Y-axis are axes along a horizontal plane and the Z-axis is an axis along a vertical line. In this embodiment, accordingly, the −Z direction denotes the direction of gravity. Also, in other drawings, the arrows represent the X direction, the Y direction, and the Z direction as appropriate. The X, Y, and Z directions in FIG. 1 and the X, Y, and Z directions in other drawings represent the same directions. Here, "orthogonal" includes a range of 90°±10°.

The liquid discharge apparatus 100 according to the embodiment is an ink jet printer that discharges an ink as a liquid for printing images on a print medium P. The liquid discharge apparatus 100 prints images on a print medium P by ejecting an ink onto the print medium P such as paper in accordance with print data, which represents on/off dot-forming operations onto the print medium P, to form dots at different points on the print medium P. The print medium P may be paper or any material that can retain liquid, such as plastic, film, fabric, cloth, leather, metal, glass, wood, or ceramics.

The liquid discharge apparatus 100 includes the liquid discharge head 200 for ejecting liquid, a carriage 40 that holds the liquid discharge head 200, a drive motor 46 for driving the carriage 40, a transport motor 51 for transporting a print medium P, an ink cartridge 80 for storing an ink as a liquid, and a controller 110.

The controller 110 is a computer that includes one or more processors, a main storage unit, and an input/output interface for exchanging signals with an external device. The controller 110 controls individual mechanisms in the liquid discharge apparatus 100 in accordance with print data to discharge an ink from the liquid discharge head 200 onto a print medium P to print images onto the print medium P. The controller 110, accordingly, controls the liquid discharge operations of the liquid discharge head 200. The controller 110 can, for example, convert image data that is received from an external computer (not illustrated) into print data.

The ink cartridge 80 stores an ink to be supplied to the liquid discharge head 200. In this embodiment, four ink cartridges 80 that store inks of different colors respectively are detachably attached to the carriage 40. The ink cartridges 80 that are attached to the carriage 40 are coupled to the liquid discharge head 200 and the inks can be supplied from the ink cartridges 80 to the liquid discharge head 200. The ink cartridges 80 may be attached, for example, to a main body of the liquid discharge apparatus 100 without being attached to the carriage 40. The ink cartridges 80 may be coupled to, for example, a flow channel such as a flexible tube or the liquid discharge head 200 via a pump such as a pressure pump. The liquid discharge apparatus 100 may include, as the mechanism for storing ink, an ink tank, or a pouch-shaped ink pack made of a flexible film instead of the ink cartridges 80.

The four ink cartridges 80 according to the embodiment store four different inks respectively, that is, black, cyan, magenta, and yellow. The types of ink and the number of inks stored in the ink cartridges 80 or ink tanks are not limited to a particular type or a particular number. For example, in other embodiments, three or fewer types of ink may be used or five or more types of ink may be used. The liquid discharge apparatus 100 may further include, for example, the ink cartridge 80 that stores an ink of a color other than the above-mentioned four colors, for example, light cyan, light magenta, or white. The number of types of ink may correspond to or may not correspond to the number of ink cartridges 80 or ink tanks.

The liquid discharge head 200 discharges the inks supplied from the ink cartridges 80 in a form of droplets onto a print medium P. The liquid discharge head 200 is electrically coupled to the controller 110 via a flexible cable 41. The liquid discharge head 200 will be described in detail below. It should be noted that the liquid discharge apparatus 100 may include two or more liquid discharge heads 200.

The carriage 40 includes the liquid discharge head 200 as described above. The carriage 40 is reciprocated by the drive of the drive motor 46 in a main scanning direction. The main scanning direction according to the embodiment is the X direction. The carriage 40 is moved along a carriage guide (not illustrated) that is disposed in the X direction in response to the driving force that is transmitted from the drive motor 46 via a drive belt 47. As the carriage 40 reciprocates, the liquid discharge head 200, which is held on the carriage 40, and the ink cartridges 80, which are attached to the carriage 40, reciprocate in the X direction.

A print medium P is transported in a sub scanning direction that intersects the main scanning direction on a platen 55 in response to the driving force transmitted from the transport motor 51 via a transport roller (not illustrated). The sub scanning direction according to the embodiment is the Y direction. It should be noted that the main scanning direction and the sub scanning direction in this embodiment are orthogonal to each other, however, in other embodiments, the main scanning direction and the sub scanning direction may not be orthogonal to each other.

Figure 2:
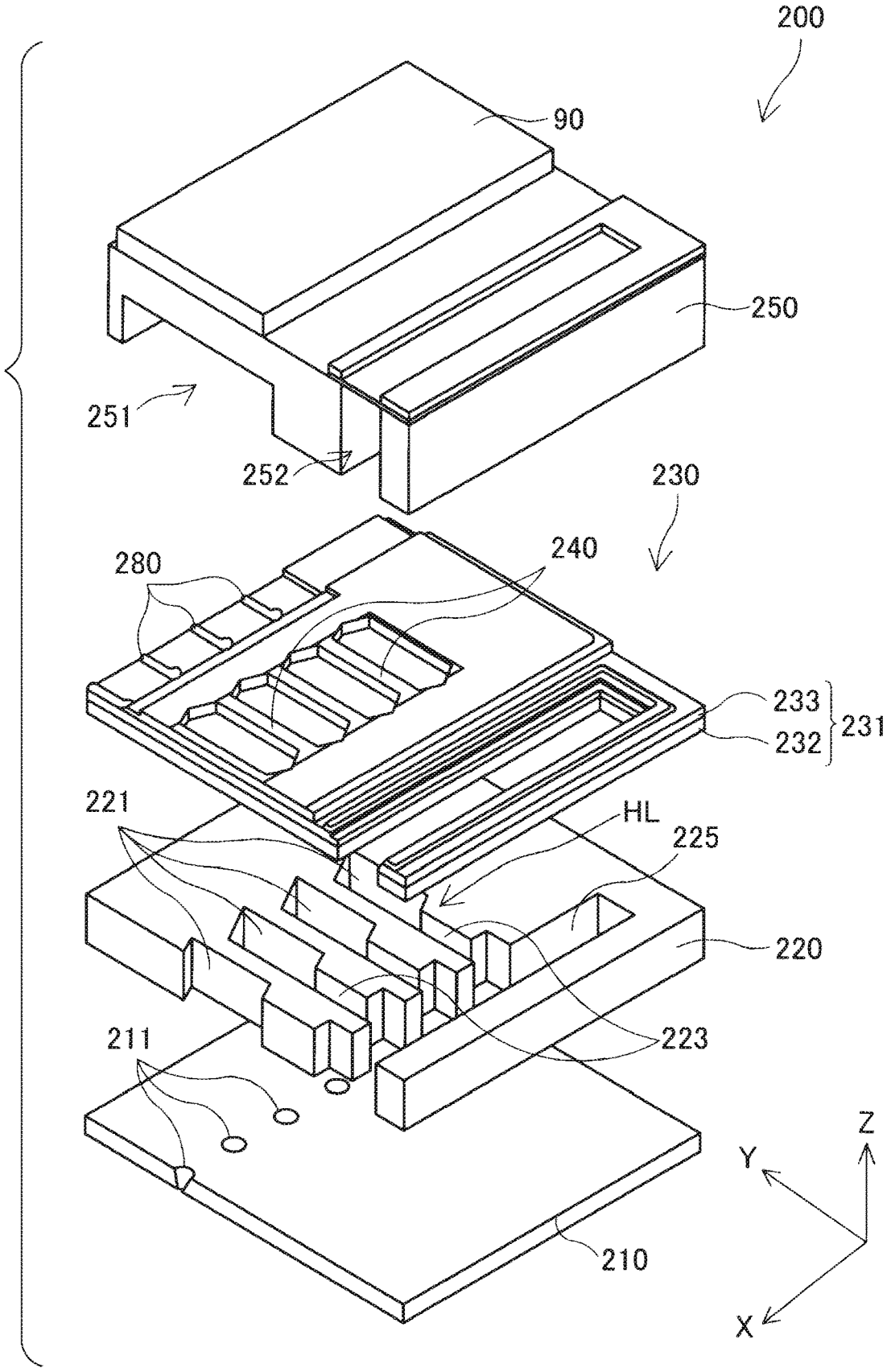
FIG. 2 is an exploded perspective view of a structure of the liquid discharge head according to the embodiment.

FIG. 2 is an exploded perspective view of a structure of the liquid discharge head 200 according to the embodiment. The liquid discharge head 200 according to the embodiment includes a nozzle plate 210, a pressure chamber plate 220, a piezoelectric section 230, and a sealing section 250, which are stacked in the Z direction.

The nozzle plate 210 is a thin plate-shaped member. The nozzle plate 210 according to the embodiment is disposed along the XY plane and is a distal end of the liquid discharge head 200 in the −Z direction. The nozzle plate 210 has many nozzles 211 that are aligned in the X-axis direction. The nozzles 211 are through holes that extend through the nozzle plate 210 in the Z-axis direction, which is a thickness direction. The liquid ejection head 200 ejects liquid from the nozzles 211. The nozzles 211 may be referred to as discharge ports. In other embodiments, the number of lines of the nozzles 211 may not be one, and two or more lines of the nozzles 211 may be formed in the nozzle plate 210.

The nozzle plate 210 according to the embodiment is made of stainless steel (SUS). The nozzle plate 210 is not limited to stainless steel, for example, the nozzle plate 210 may be plates of metals and alloys, such as nickel (Ni) and other metals, resins, such as polyimide and dry film resist, inorganic materials, such as glass ceramics, or a single crystal plate of silicon (Si).

The pressure chamber plate 220 is a plate-like member that defines pressure chambers 221. As illustrated in FIG. 2, the pressure chamber plate 220 is stacked on the nozzle plate 210. More specifically, a −Z side of the pressure chamber plate 220 is joined to a +Z side of the nozzle plate 210 with an adhesive. In other embodiments, the pressure chamber plate 220 and the nozzle plate 210 may be joined together without using adhesive. For example, the pressure chamber plate 220 may be joined to the nozzle plate 210 with a heat welding film.

The pressure chamber plate 220 according to the embodiment is made of a single crystal substrate of silicon (Si). In other embodiments, the pressure chamber plate 220 is not limited to the single crystal substrate of silicon (Si), and the pressure chamber plate 220 may be, for example, plates of other materials mainly composed of silicon (Si), ceramics, and glass.

As illustrated in FIG. 2, the pressure chamber plate 220 has a hole HL that extends through the pressure chamber plate 220 in the Z direction to define the pressure chambers 221, ink supply channels 223, and a communication portion 225. The pressure chambers 221, the ink supply channels 223, and the communication portion 225 are defined by the pressure chamber plate 220 that is stacked on the nozzle plate 210, and a vibrating plate 231, which will be described below, that is stacked on the pressure chamber plate 220. It should be noted that, for example, the vibrating plate 231 may be stacked on the pressure chamber plate 220, and then a part of or all of the hole HL may be formed.

As illustrated in FIG. 2, the pressure chamber plate 220 defines a plurality of pressure chambers 221. The pressure chambers 221 according to the embodiment are arranged in the X direction. The individual pressure chambers 221 that are defined by the pressure chamber plate 220 stacked on the nozzle plate 210 communicate with the nozzles 211. The pressure chambers 221 according to the embodiment are arranged in the X direction so as to correspond to the arrays of the nozzles 211. The direction in which the pressure chambers 221 are arrayed may be referred to as a first direction. The first direction according to the embodiment is the X direction.

As illustrated in FIG. 2, each of the pressure chambers 221 is substantially a parallelogram that is long in the Y direction when viewed in the Z direction. More specifically, each of the pressure chambers 221 extends in the Y direction. The direction in which the pressure chambers are arrayed may be referred to as a second direction. The second direction according to the embodiment is the Y direction.

The communication portion 225 is a space common to the individual pressure chambers 221. The communication portion 225 communicates with each of the pressure chambers 221 through the ink supply channels 223. The ink supply channel 223 has a width less than that of the pressure chamber 221 and functions as a flow channel resistance to the ink supplied from the communication portion 225 into the pressure chamber 221.

As illustrated in FIG. 2, the piezoelectric section 230 includes the vibrating plate 231 and piezoelectric elements 240 that are stacked on the pressure chamber plate 220.

The vibrating plate 231 is disposed between the piezoelectric elements 240 and the pressure chamber plate 220. The vibrating plate 231 according to the embodiment includes a flexible layer 232 on the pressure chamber plate 220 and a protective layer 233 on the flexible layer 232. The flexible layer 232 is made of, for example, silicon dioxide and the protective layer 233 is made of, for example, zirconium oxide.

In the piezoelectric section 230, the piezoelectric elements 240 are deformed to bend the vibrating plate 231 to change the volume of the pressure chambers 221. The bending of the vibrating plate 231 due to the deformation of the piezoelectric elements 240 may be referred to as vibration or simply referred to as deformation. The piezoelectric section 230 may be referred to as an actuator. The structure of the piezoelectric section 230 and the piezoelectric elements 240 will be described in detail below.

The sealing section 250 is joined to the piezoelectric section 230 with an adhesive. The sealing section 250 includes a piezoelectric element accommodating section 251 and a manifold section 252. A drive circuit 90 is disposed on a +Z side of the sealing section 250.

The sealing section 250 according to the embodiment is made of a single crystal substrate of silicon (Si). The sealing section 250 may be made of other materials such as ceramic materials and glass materials. In such a case, the sealing section 250 may be made of a material with a coefficient of thermal expansion substantially equal to that of the pressure chamber plate 220.

The piezoelectric element accommodating section 251 is a portion of the sealing section 250 that faces the piezoelectric elements 240. The piezoelectric element accommodating section 251 has a sufficient space that does not interfere with the movement of the piezoelectric elements 240. The piezoelectric elements 240 are accommodated in the space in the piezoelectric element accommodating section 251. The manifold section 252 extends in the X direction and the Z direction of the sealing section 250. The manifold section 252 communicates with the communication portion 225 of the pressure chamber plate 220.

The drive circuit 90 supplies drive signals for driving the piezoelectric elements 240 to the piezoelectric elements 240. The drive circuit 90 may be, for example, a circuit board or a semiconductor integrated circuit (IC). The drive circuit 90 is electrically coupled to the piezoelectric elements 240 via lead electrodes 280 and electrical wiring (not illustrated). The drive circuit 90 is electrically coupled to the controller 110 via electrical wiring (not illustrated).

Figure 3:
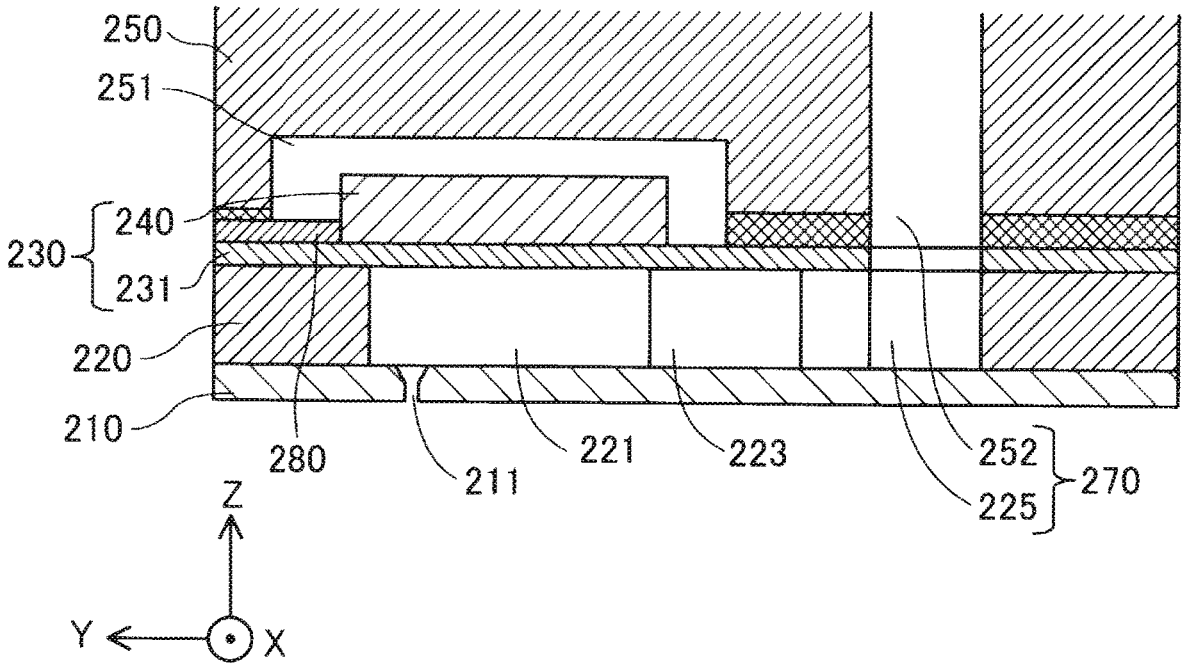
FIG. 3 is a schematic cross-sectional view illustrating main components of the liquid discharge head.

FIG. 3 is a schematic cross-sectional view illustrating main components of the liquid discharge head 200 taken along the YZ plane. As illustrated in FIG. 3, in the structure in which the above-described components are stacked, the manifold section 252 and the communication portion 225 communicate with each other and a manifold 270 function as a common liquid chamber for the individual pressure chambers 221. In addition, the nozzle 211, the pressure chamber 221, the ink supply channel 223, and the manifold 270 communicate with each other to form an ink flow channel. In the liquid discharge head 200, the volume of the individual pressure chambers 221 is changed by the piezoelectric section 230 to discharge the liquid, which is supplied to the pressure chambers 221 through the flow channels, from the nozzles 211. The manifold 270 may be referred to as a common liquid chamber or a reservoir.

Figure 4:
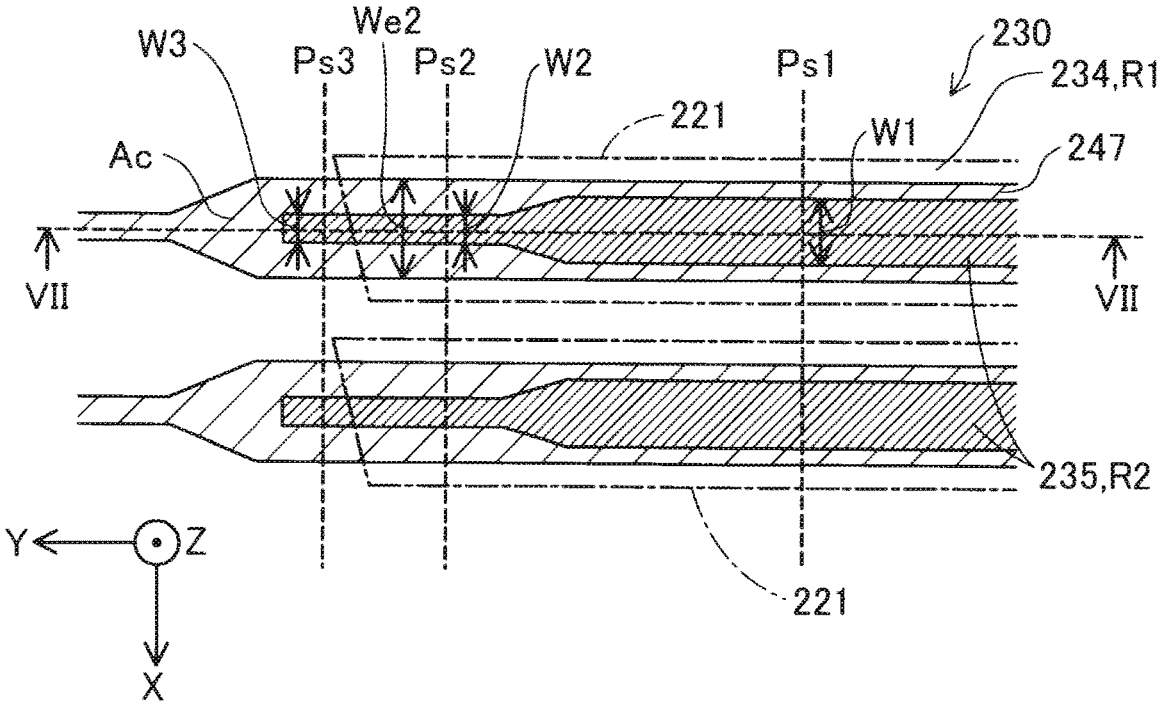
FIG. 4 illustrates a schematic structure of a piezoelectric section.

FIG. 4 illustrates a schematic structure of the piezoelectric section 230. In FIG. 4, portions of the pressure chambers 221 on the XY plane are indicated by alternate long and short dashed lines. FIG. 4 illustrates a first position Ps1 and a second position Ps2 with broken lines. The first position Ps1 and the second position Ps2 are specific positions respectively in the pressure chambers 221 in the Y direction. The second position Ps2 is closer to an end of the pressure chamber 221 than the first position Ps1 in the Y direction.

Figure 5:
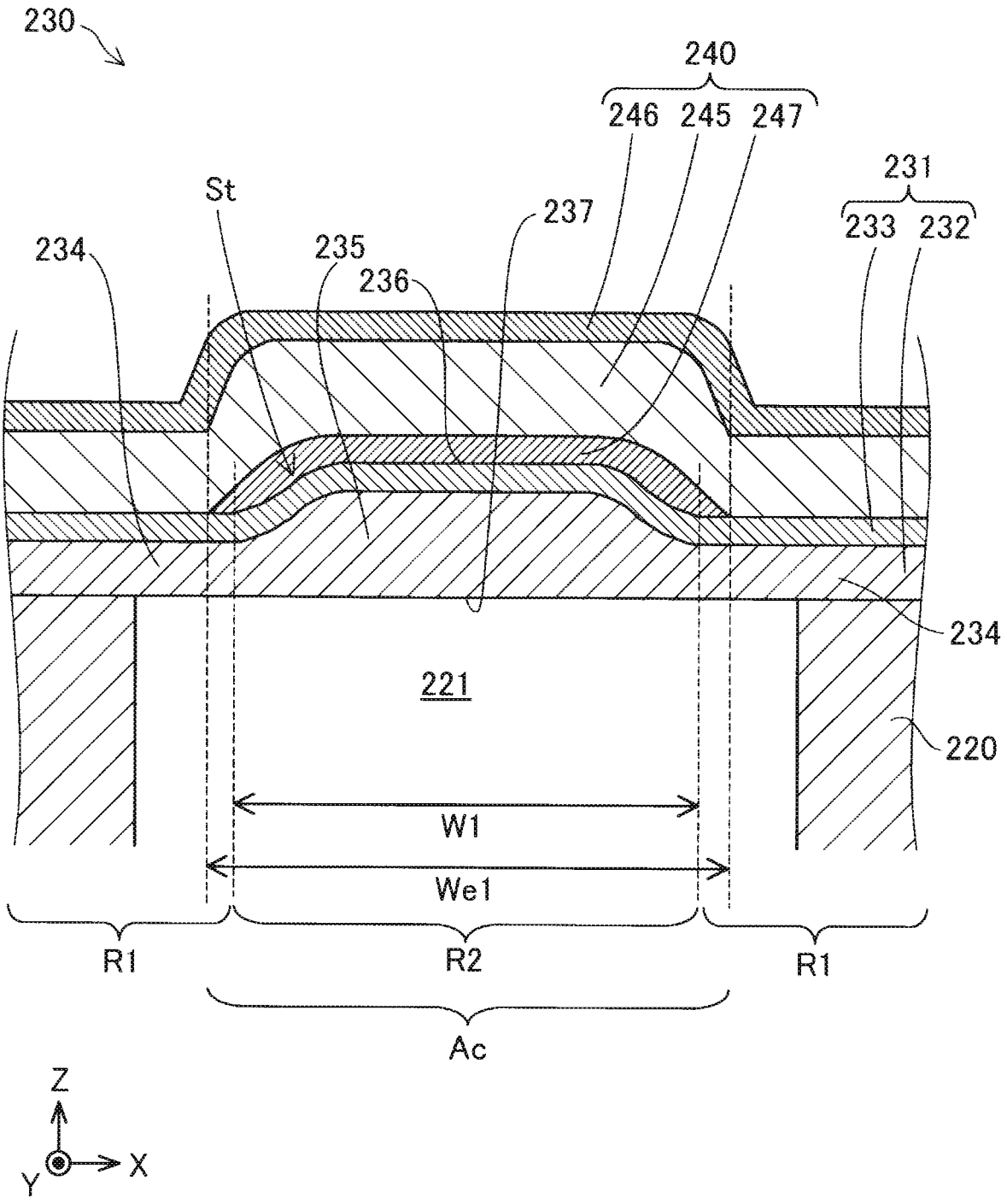
FIG. 5 is a cross-sectional view of the piezoelectric section and a pressure chamber plate at a first position according to the first embodiment.

FIG. 5 is a cross-sectional view of the piezoelectric section 230 and the pressure chamber plate 220 in the first position Ps1 taken along the XZ plane. As described above, the piezoelectric section 230 includes the vibrating plate 231 and the piezoelectric elements 240.

The piezoelectric elements 240 according to the embodiment are a laminate of a piezoelectric material 245, a first electrode 246, and second electrodes 247.

The piezoelectric material 245 according to the embodiment is made of lead zirconate titanate (PZT). It should be noted that instead of PZT, the piezoelectric material 245 may be made of any ceramic material that has a ABO3 perovskite structure, for example, barium titanate, lead titanate, potassium niobate, lithium niobate, lithium tantalate, sodium tungstenate, zinc oxide, barium strontium titanate (BST), strontium bismuth tantalate (SBT), lead metaniobate, lead zinc niobate, or lead scandium niobate. The material of the piezoelectric material 245 is not limited to the ceramic materials and may be any material that has a piezoelectric effect such as polyvinylidene fluoride or crystal.

The first electrode 246 is a common electrode for the pressure chambers 221. The second electrodes 247 are electrodes for the individual pressure chambers 221. The first electrode 246 may be referred to as a common electrode, and the second electrodes 247 may be referred to as individual electrodes. In FIG. 4, the piezoelectric material 245 and the first electrode 246 are omitted to facilitate understanding of the structure. The first electrode 246 according to the embodiment extends over the pressure chambers 221 in the X direction. In FIG. 4, the first electrode 246 extends across the entire XY plane. In addition, in FIG. 4, portions in the piezoelectric section 230 where the second electrodes 247 are disposed in the XY plane are hatched by lines sloping upward to the right. More specifically, in FIG. 4, portions hatched by fine lines sloping upward to the right and portions hatched by coarse lines correspond to the portions where the second electrodes 247 are disposed.

The second electrodes 247 according to the embodiment are disposed between the piezoelectric material 245 and the vibrating plate 231. More specifically, the second electrodes 247 are disposed below the piezoelectric material 245 and may be referred to as lower electrodes. The second electrodes 247 according to the embodiment extend in the Y direction, which is a long-side direction of the pressure chambers 221. On the other hand, the first electrode 246 is disposed above the second electrodes 247 with the piezoelectric material 245 disposed therebetween. More specifically, the first electrode 246 is disposed above the piezoelectric material 245 and may be referred to as an upper electrode. The first electrode 246 and the second electrode 247 are made of, for example, a metal such as platinum, iridium, titanium, tungsten, or tantalum, or a conductive metal oxide such as lanthanum nickel oxide ($LaNiO_3$).

FIG. 5 illustrates an active area Ac. The active area Ac is an area that corresponds to an active area of the piezoelectric material 245 in the XY plane. The active area of the piezoelectric material 245 is a portion of the piezoelectric material 245 between the first electrode 246 and the second electrode 247 in the Z direction. In the active area of the piezoelectric material 245, in response to an application of a voltage to the piezoelectric material 245 through the first electrode 246 and the second electrode 247, piezoelectric distortion occurs. The piezoelectric elements 240 deform the vibrating plate 231 by the deformation due to the piezoelectric distortion. In FIG. 4, the active area Ac corresponds to the area in which the second electrode 247 is disposed in the XY plane.

As illustrated in FIG. 4 and FIG. 5, the vibrating plate 231 includes a first portion 234 and a second portion 235. The second portion 235 is away from an end of the pressure chamber 221 as compared with the first portion 234 in the X direction. The second portion 235 has a thickness different from that of the first portion 234. With this structure, the vibrating plate 231 has a step height St in a region between the first portion 234 and the second portion 235 as illustrated in FIG. 5. More specifically, in this embodiment, the thickness of the second portion 235 is greater than the thickness of the first portion 234. In FIG. 4, portions in the piezoelectric section 230 that correspond to the second portions 235 in the vibration plate 231 in the XY plane are hatched by fine lines sloping upward to the right. As illustrated in FIG. 4, the second portions 235 extend in the Y direction and have portions in which the widths in the X direction change in the Y direction. More specifically, the second portions 235 have portions in which the widths in the X direction decrease toward the Y direction. In addition, as illustrated in FIG. 4 and FIG. 5, in the XY plane, an area that corresponds to the first portion 234 may be referred to as a first area R1, and an area that corresponds to the second portion 235 may be referred to as a second area R2.

As illustrated in FIG. 5, the vibrating plate 231 has a first surface 236 that is away from the pressure chamber 221 and a second surface 237 that is opposite to the first surface 236 in the Z direction. The first surface 236 is a surface of the vibrating plate 231 in the +Z direction, and the second surface 237 is a surface of the vibrating plate 231 in the −Z direction. As illustrated in FIG. 5, the second portion 235 of the vibrating plate 231 according to the embodiment protrudes in the +Z direction. The first surface 236 in the second portion 235 is opposite to the pressure chamber 221 in the Z direction, which is the thickness direction of the vibrating plate 231, with respect to the first surface 236 in the first portion 234. The position of the second surface 237 in the Z direction is the same in the first portion 234 and the second portion 235. In this embodiment, the first surface 236 is the protective layer 233, and the second surface 237 is the flexible layer 232. The thickness direction includes both one direction and the other direction on the one axis.

The vibrating plate 231 that has the step height St is formed, for example, by forming the vibrating plate 231 on the pressure chamber plate 220 and removing part of the vibrating plate 231. In this embodiment, for example, part of the flexible layer 232, which is formed on the pressure chamber plate 220 before the formation of the pressure chamber 221, that corresponds to the first portion 234 is removed by etching with photoresist masking, and then, the protective layer 233 is formed on the flexible layer 232. By the processing, the vibrating plate 231 that has the portion corresponding to the second portion 235 that is thicker than the first portion 234 is formed. In other embodiments, the thickness of the protective layer 233 may be different in the first portion 234 and the second portion 235. In fabricating the vibrating plate 231, the surface of the vibrating plate 231 may be smoothed, for example, by etching. The flexible layer 232 is formed on the pressure chamber plate 220, for example, by thermal oxidation or chemical-vapor deposition (CVD). The protective layer 233 is formed on the flexible layer 232, for example, by CVD. The pressure chambers 221 according to the embodiment are formed, for example, by forming the vibrating plate 231 and then removing the portions that correspond to the pressure chambers 221 in the pressure chamber plate 220, for example, by etching.

The piezoelectric material 245, the first electrode 246, and the second electrodes 247 may be formed by etching with photoresist masking to adjust positions of the components and thickness at the positions of the individual components. The first electrode 246 and the second electrodes 247 are formed, for example, by sputtering with a target material such as platinum. The piezoelectric elements 240 are formed, for example, by a sol-gel method, and are coated on the vibrating plate 231 and the second electrodes 247. The coating method may be, for example, a spin-coating method.

The first portion 234 and the second portion 235 that have different thicknesses according to the embodiment enable the piezoelectric section 230 to have different neutral axis positions in the first area R1 and the second area R2. The neutral axis of the piezoelectric section 230 is an axis portion that intersects a neutral surface in a cross section of the piezoelectric section 230 taken along the YZ plane. The neutral surface of the piezoelectric section 230 is a surface that is neither compressed nor stretched when the piezoelectric section 230 is subjected to a bending moment. The piezoelectric section 230 according to the embodiment bends and deforms in the Z direction, and thus the neutral surface is a surface that intersects the Z direction and the neutral axis is an axis in the X direction. For example, when the active area of the piezoelectric element 240 contracts and deforms, in the cross section in the first position Ps1 in FIG. 5, a compressive distortion occurs in a portion away from the neutral axis of the piezoelectric section 230 in the +Z direction and a tensile distortion occurs in a portion away from the neutral axis in the −Z direction.

For example, in the embodiment, the second portion 235 is thicker than the first portion 234, and in each position in the Y direction, the neutral axis in the second area R2 is away from the neutral axis in the first area R1 in the +Z direction. With this structure, the portion of the piezoelectric element 240 away from the neutral axis in the +Z direction in the second area R2 is larger than that in the first area R1. In the second area R2, accordingly, when the piezoelectric element 240 deforms, the vibrating plate 231 can be highly efficiently deformed. On the other hand, the portion of the piezoelectric element 240 away from the neutral axis in the −Z direction in the first area R1 is larger than that in the second area R2. Accordingly, in the first area R1, deformation of the piezoelectric element 240 is suppressed, thereby suppressing excessive deformation of the vibrating plate 231. The first area R1 is closer to an end of the pressure chamber 221 than the second area R2 in the X direction, and the portion of the piezoelectric section 230 in the first area R1 is likely to be damaged due to excessive deformation of the vibrating plate 231. The first portion 234 that is thinner than the second portion 235, however, can effectively suppress the damage to the piezoelectric section 230.

Figure 6:
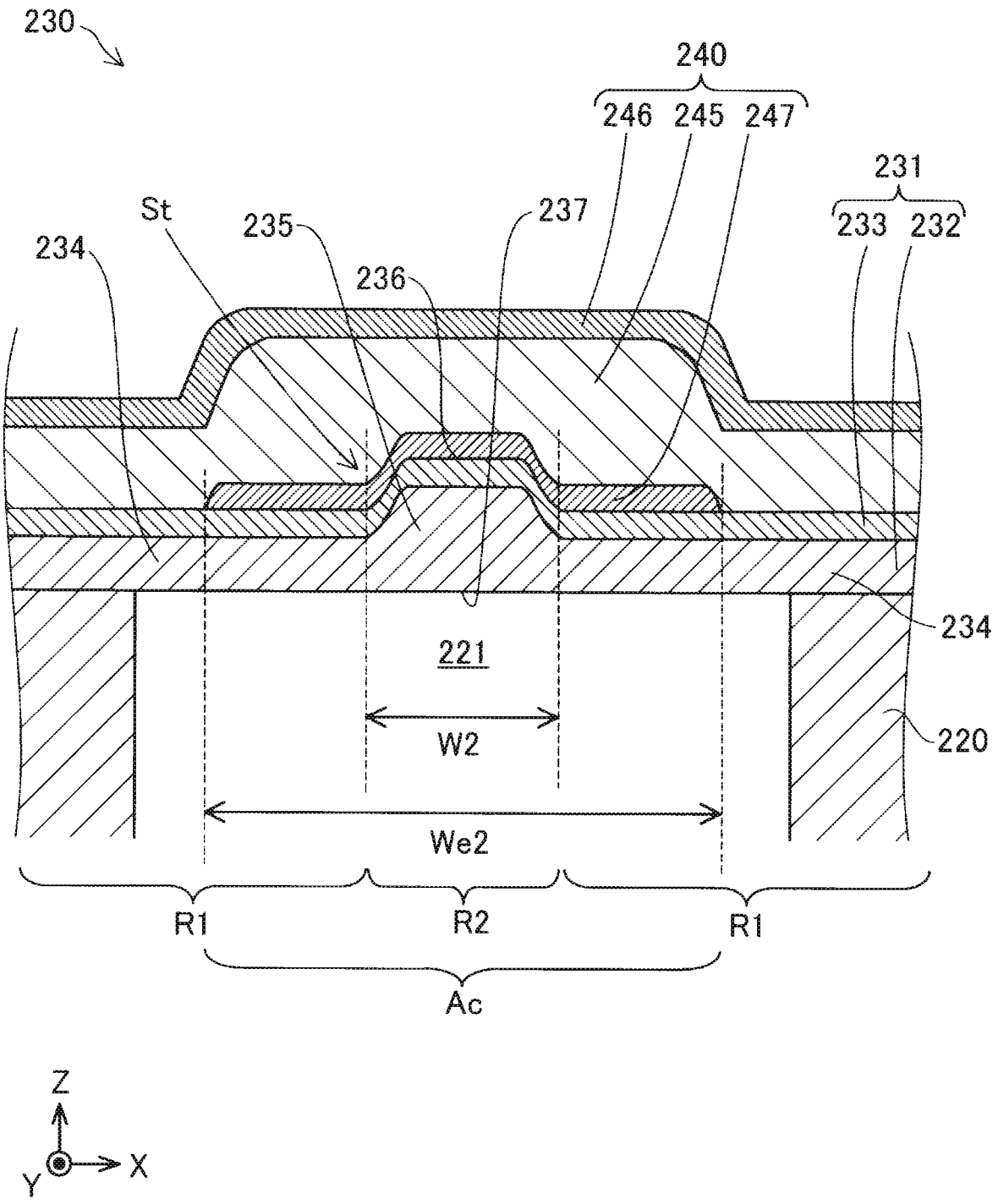
FIG. 6 is a cross-sectional view of the piezoelectric section and the pressure chamber plate at a second position according to the first embodiment.

FIG. 6 is a cross-sectional view of the piezoelectric section 230 and the pressure chamber plate 220 in the second position Ps2. As illustrated in FIG. 4 to FIG. 6, a second width W2 of the second portion 235 in the X direction in the second position Ps2 is less than a first width W1 of the second portion 235 in the X direction in the first position Ps1.

In this embodiment, the second portion 235 extends to the second position Ps2, and thus the piezoelectric element 240 can more effectively deform the vibrating plate 231 than in a case in which the second portion 235 does not extend to the second position Ps2.

In addition, since the second width W2 is less than the first width W1, the region between the first area R1 and the second area R2 in the second position Ps2 is away from an end of the pressure chamber 221 in the X direction than the region between the first area R1 and the second area R2 in the first position Ps1. In the region between the first area R1 and the second area R2, the vibrating plate 231 has the step height St, and the region is subject to stress concentration. In addition, in the second position Ps2, the region near the end of the pressure chamber 221 in the X direction is close to the end of the pressure chamber 221 in the X direction and the Y direction and thus the region is susceptible to damage. Accordingly, the second width W2 that is less than the first width W1 can reduce the stress concentration on the region near the end of the pressure chamber 221 in the X direction and the Y direction, effectively suppressing the damage to the piezoelectric section 230.

Figure 7:
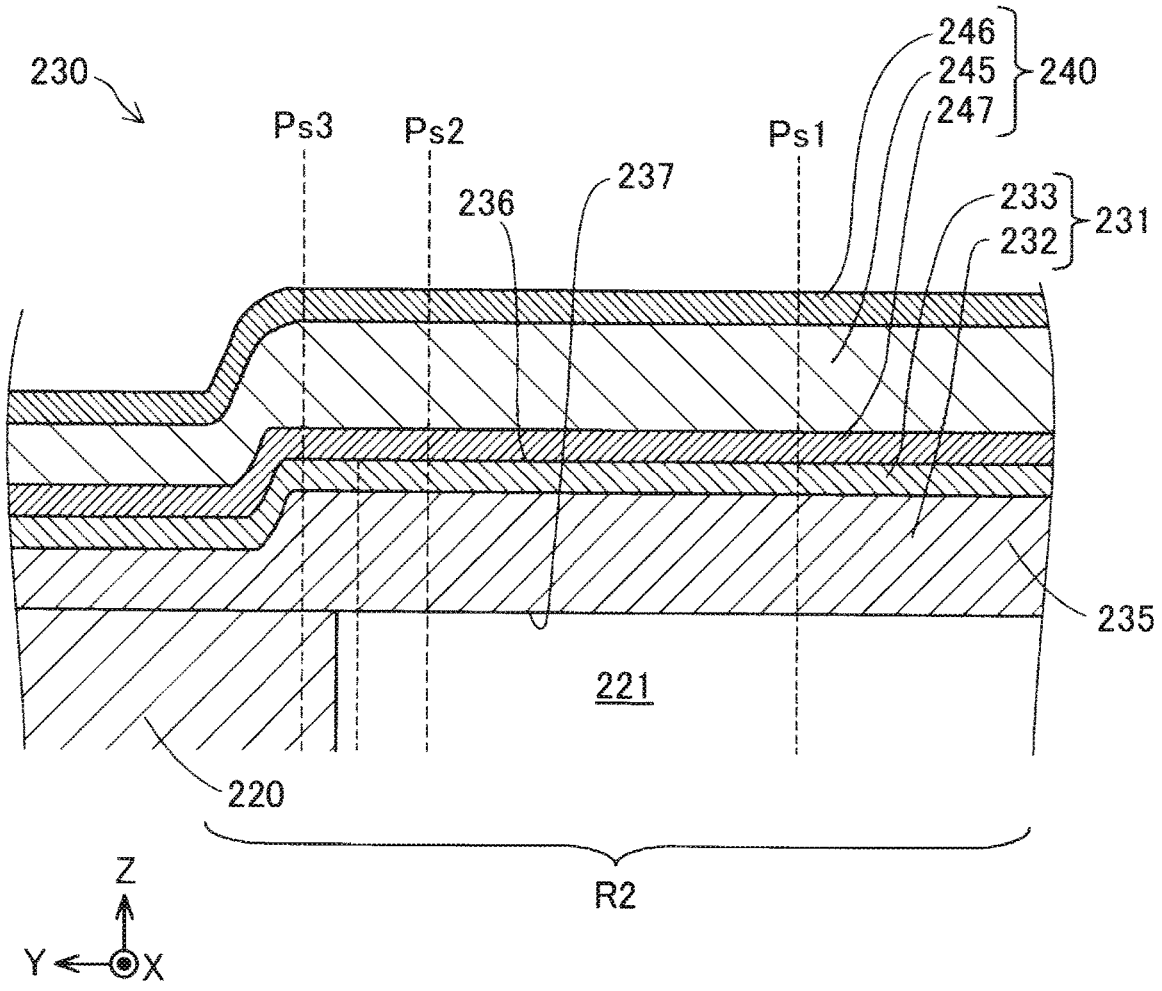
FIG. 7 is a cross-sectional view of the piezoelectric section taken along line VII-VII in FIG. 4.

FIG. 7 is a cross-sectional view of the piezoelectric section 230 taken along line VII-VII in FIG. 4. FIG. 4 and FIG. 7 illustrate a third position Ps3 in addition to the first position Ps1 and the second position Ps2. The third position Ps3 is outside the area where the pressure chamber 221 extends in the Y direction. In this embodiment, as illustrated in FIG. 4 and FIG. 7, the first portion 234 and the second portion 235 of the vibrating plate 231 extends to the third position Ps3. As illustrated in FIG. 4, in the third position Ps3, a third width W3 of the second portion 235 in the X direction is equal to the second width W2. In this embodiment, the shapes of the cross sections of the piezoelectric section 230 and the pressure chamber plate 220 in the third position Ps3 are similar to those in the second position Ps2 in FIG. 6. It should be noted that the third width W3 may be a width less than or equal to the second width W2, and in other embodiments, for example, the third width W3 may be less than the second width W2.

The second portion 235 that extends to the third position Ps3 achieves the effects of the step height St of the vibrating plate 231 in the region close to the end of the pressure chamber 221 in the Y direction as compared with a case in which the second portion 235 does not extend to the third position Ps3. For example, the piezoelectric element 240 according to the embodiment can effectively deform the vibrating plate 231 in the region close to the end of the pressure chamber 221 in the Y direction. In addition, the third width W3 that is less than or equal to the second width W2 can suppress the damage to the piezoelectric section 230 in the region close to the end of the pressure chamber 221 in the X direction and the Y direction in the structure in which the second portion 235 extends to the third position Ps3.

In this embodiment, as illustrated in FIG. 4 and FIG. 6, a width We2 of the second electrode 247 in the X direction in the second position Ps2 is greater than the second width W2. In addition, the second electrode 247 according to the embodiment covers the second portion 235 in the second position Ps2. In this embodiment, the widths of the second electrode 247 in the X direction in the first position Ps1 and in the X direction in the third position Ps3 are equal to the width We2. The width We2 is greater than the first width W1. In addition, the second electrode 247 according to the embodiment covers the second portion 235 also in the first position Ps1 and the third position Ps3.

The second electrode 247 has the width We2 greater than the second width W2 of the second portion 235, and thus the active area Ac covers part of the first area R1 and the second area R2 in the second position Ps2 as illustrated in FIG. 6. In this embodiment, as described above, the neutral axis in the second area R2 is away from the neutral axis in the first area R1 in the +Z direction. Accordingly, when a voltage is applied to the piezoelectric element 240, although the first portion 234 is deformed, the first portion 234 is less deformed than the second portion 235. With this structure, in the second position Ps2, the stress concentration on the region between the first portion 234 and the second portion 235 in the X direction can be further suppressed.

In the liquid discharge head 200 according to the first embodiment, the second width W2 of the second portion 235 of the vibrating plate 231 in the second position Ps2 that is closer to an end of the pressure chamber 221 than the first position Ps1 in the second direction is less than the first width W1 in the first position Ps1. Accordingly, in the first direction, the step height St between the region close to the end and the central portion away from the end in the vibrating plate 231 achieves the effect of the step height St of the vibrating plate 231 also in the region near the end of the pressure chamber 221 in the second direction, and thus damage to the vibrating plate 231 and the piezoelectric element 240 in the region near the end of the pressure chamber 221 in the second direction can be suppressed.

In this embodiment, the second portion 235 in the vibrating plate 231 extends to the third position Ps3 that is outside the area where the pressure chamber 221 extends in the second direction, and the third width W3 of the second portion 235 in the third position Ps3 is less than or equal to the second width W2. Accordingly, the effect of the step height St of the vibrating plate 231 can be achieved also in the region near the end of the pressure chamber 221 in the second direction, and thus damage to the vibrating plate 231 and the piezoelectric element 240 in the region near the end of the pressure chamber 221 in the second direction can be suppressed.

In addition, the thickness of the second portion 235 according to the embodiment is greater than the thickness of the first portion 234. With this structure, the durability of the vibrating plate 231 in the first portion 234 is increased. Furthermore, in the portion of the pressure chamber 221 that corresponds to the second portion 235, the amount of change in volume in the pressure chamber 221 can be increased, and thus the liquid discharge efficiency of the liquid discharge head 200 can be increased.

In this embodiment, in the Z direction, the first surface 236 in the second portion 235 is opposite to the pressure chamber 221 with respect to the first surface 236 in the first portion 234, and the position of the second surface 237 in the first portion 234 is the same as the position of the second surface 237 in the second portion 235. With this simple structure, the second portion 235 can have a thickness greater than that of the first portion 234.

In addition, the piezoelectric elements 240 according to the embodiment are a laminate of the piezoelectric materials 245, the first electrode 246, which is a common electrode for the piezoelectric materials 245, and the second electrodes 247, which are provided for the individual piezoelectric materials 245. In such a structure, in the first direction, with the step height St between the region close to an end and the central portion away from the end in the vibrating plate 231, damage to the vibrating plate 231 and the piezoelectric element 240 in the region near the end of the pressure chamber 221 in the second direction can be suppressed.

The second electrode 247 according to the embodiment is disposed between the piezoelectric material 245 and the vibrating plate 231, and the first electrode 246 is disposed above the second electrode 247 with the piezoelectric material 245 disposed therebetween. Accordingly, in a structure in which the first electrode 246 is an upper electrode and the second electrode 247 is a lower electrode, damage to the vibrating plate 231 and the piezoelectric element 240 in the region near the end of the pressure chamber 221 in the second direction can be suppressed.

In this embodiment, the width We1 of the second electrode 247 in the first direction in the second position Ps2 is greater than the second width W2. With this structure, in the second position Ps2, the second electrode 247 overlaps the portion that corresponds to the region between the first portion 234 and the second portion 235, and thus damage to the vibrating plate 231 and the piezoelectric element 240 in the region between the first portion 234 and the second portion 235 can be suppressed.

In addition, the second electrode 247 according to the embodiment covers the second portion 235 in the second position Ps2. With this structure, in the second position Ps2, the region between the first portion 234 and the second portion 235 is directly supported by the second electrode 247, and thus damage to the vibrating plate 231 and the piezoelectric element 240 in the portion that corresponds to the region between the first portion 234 and the second portion 235 can be suppressed.

B. Second Embodiment

Figure 8:
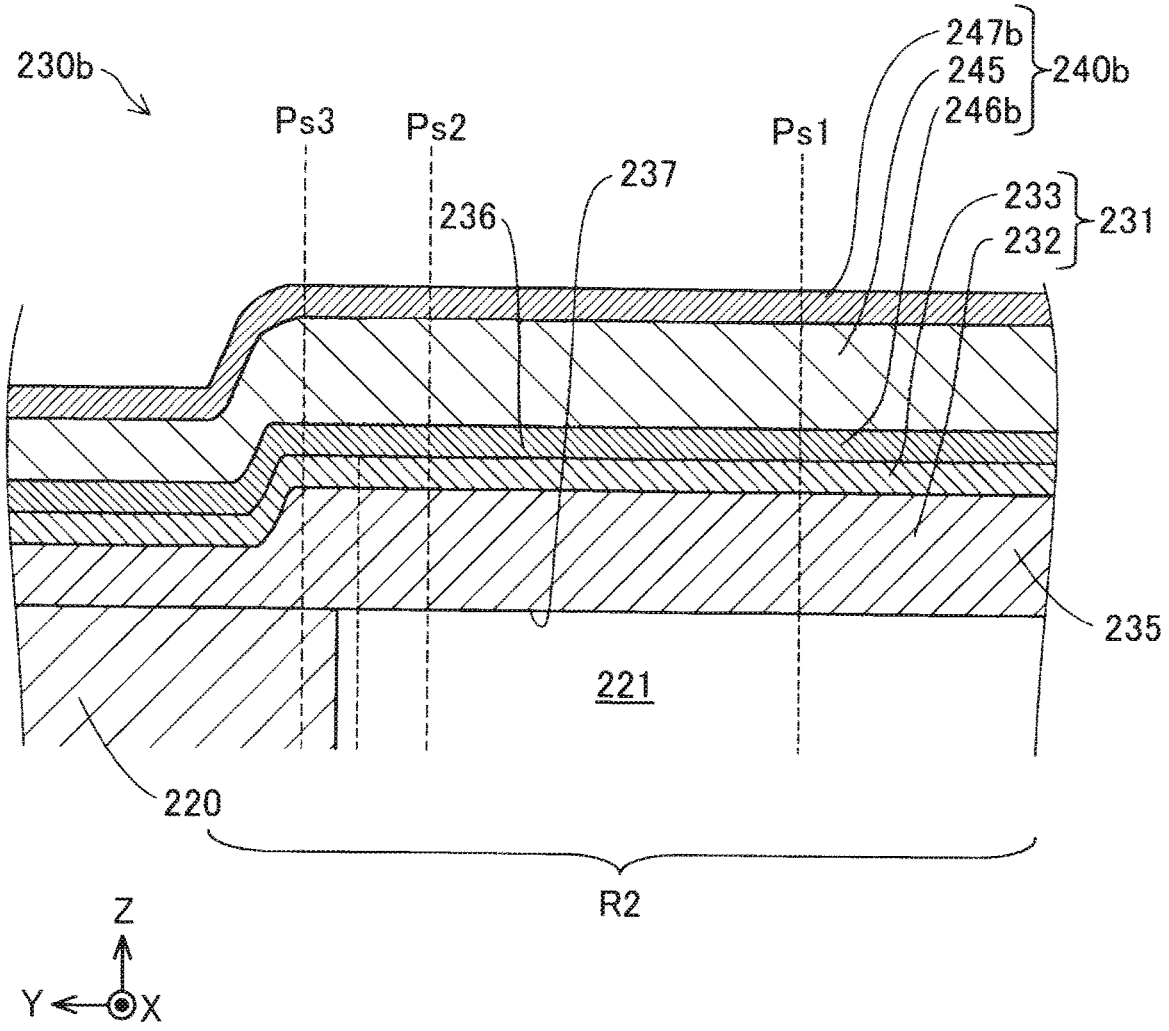
FIG. 8 is a cross-sectional view of a piezoelectric section and a pressure chamber plate according to a second embodiment.

FIG. 8 is a cross-sectional view of a piezoelectric section 230*b* and the pressure chamber plate 220 according to a second embodiment taken along the YZ plane. The embodiment is different from the first embodiment in that a first electrode 246*b* that is a common electrode in a piezoelectric element 240*b* is disposed between the piezoelectric material 245 and the vibrating plate 231. On the other hand, second electrodes 247*b* that are individual electrodes are disposed above the first electrode 246*b* with the piezoelectric material 245 disposed therebetween. In this embodiment, accordingly, the first electrode 246*b* corresponds to a lower electrode, and the second electrodes 247*b* correspond to upper electrodes. It should be noted that components that are not particularly mentioned in the liquid discharge apparatus 100 and the liquid discharge head 200 according to the second embodiment are similar to those in the first embodiment.

Figure 9:
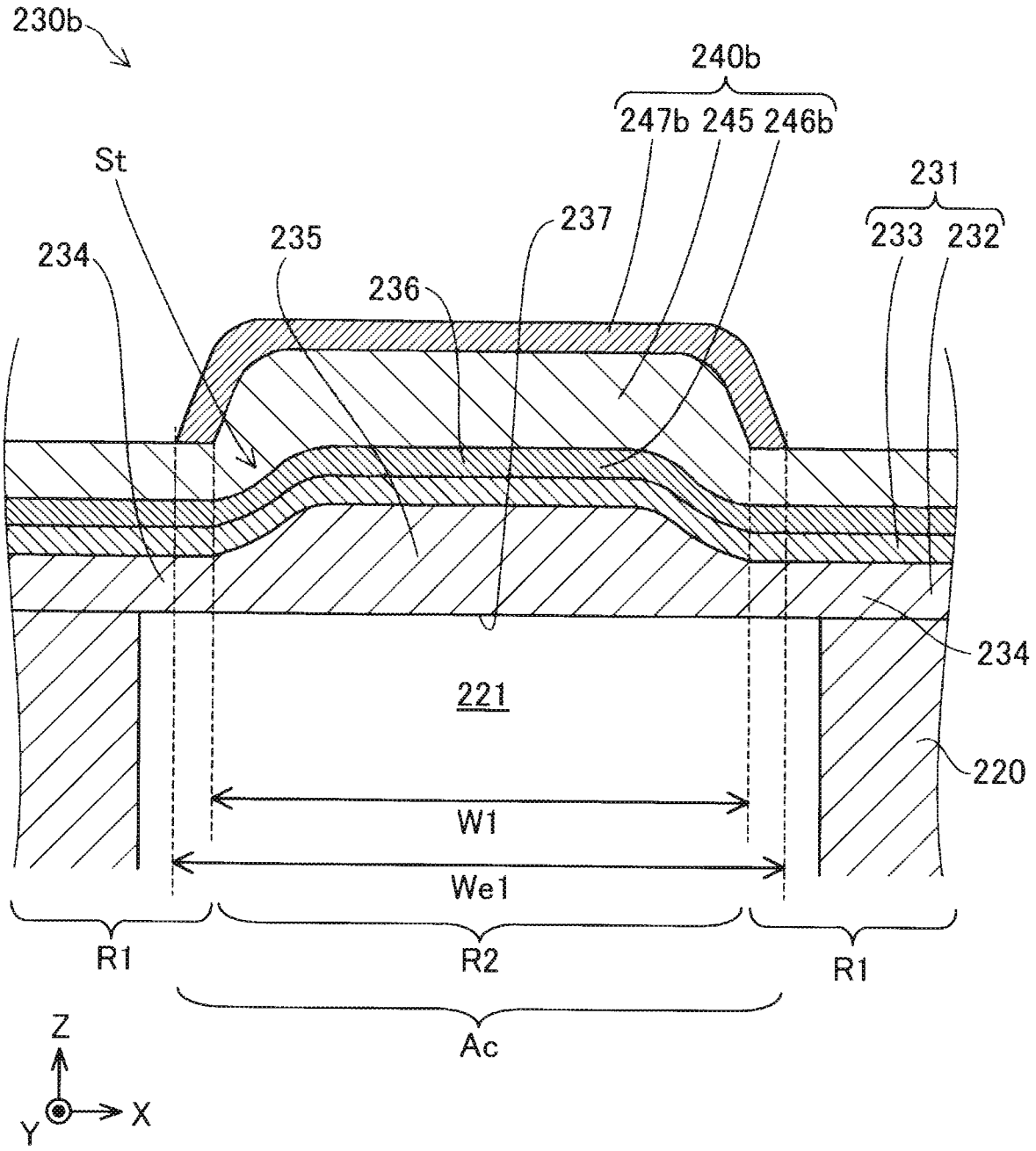
FIG. 9 is a cross-sectional view of the piezoelectric section and the pressure chamber plate at a first position according to the second embodiment.
Figure 10:
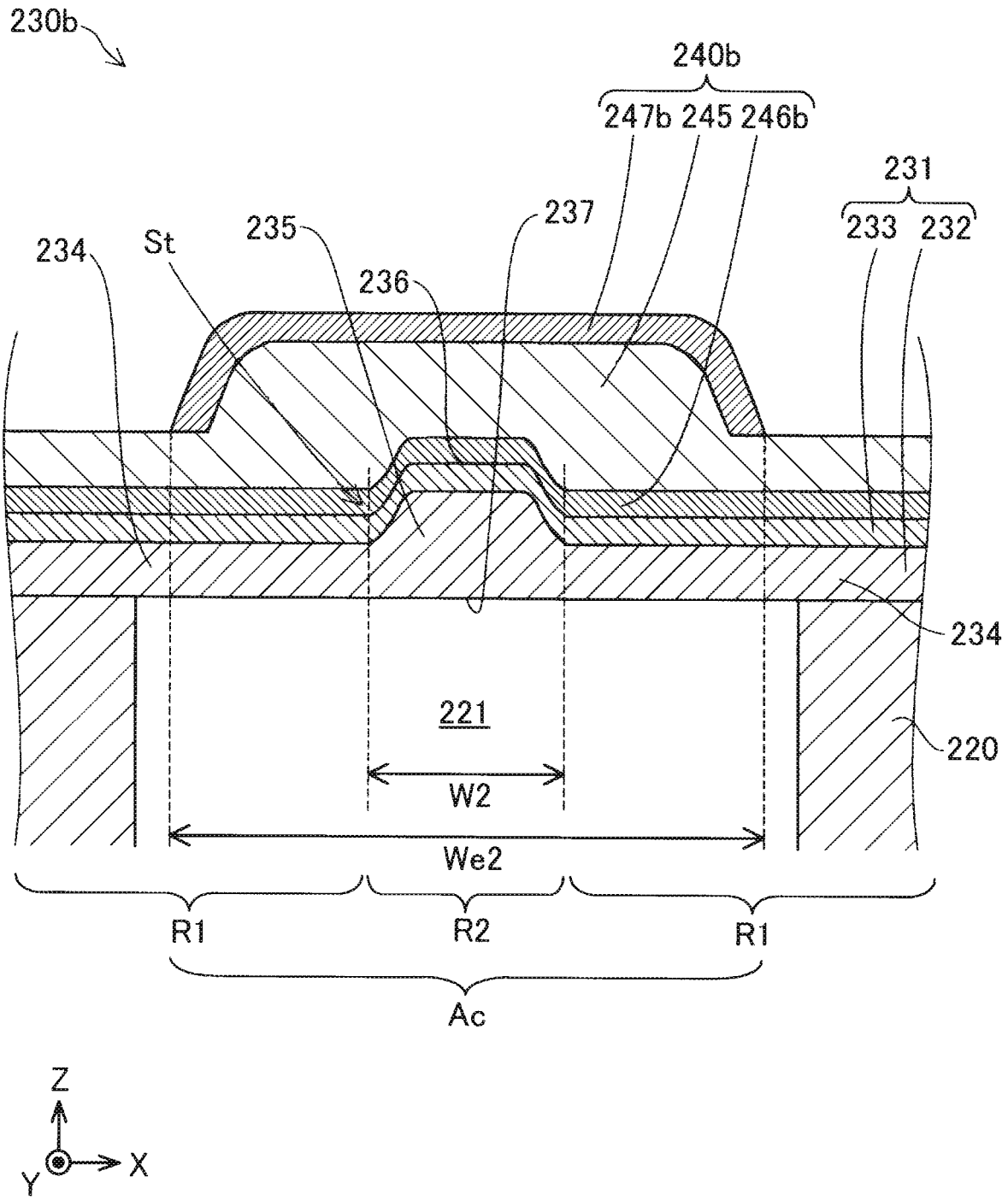
FIG. 10 is a cross-sectional view of the piezoelectric section and the pressure chamber plate at a second position according to the second embodiment.

FIG. 9 is a cross-sectional view of the piezoelectric section 230*b* and the pressure chamber plate 220 in the first position Ps1. FIG. 10 is a cross-sectional view of the piezoelectric section 230*b* and the pressure chamber plate 220 in the second position Ps2. As illustrated in FIG. 9 and FIG. 10, the vibrating plate 231 according to the embodiment includes the first portion 234 and the second portion 235 similarly to the first embodiment. The second portion 235 has a thickness different from that of the first portion 234. The thickness of the second portion 235 is greater than that of the first portion 234 similarly to the first embodiment.

In the liquid discharge head 200 according to the second embodiment, in the first direction, with the step height St between the region close to an end and the central portion away from the end in the vibrating plate 231, damage to the vibrating plate 231 and the piezoelectric element 240 in the region near the end of the pressure chamber 221 in the second direction can be suppressed. In particular, according to the embodiment, with the structure in which the first electrode 246*b* is a lower electrode and the second electrodes 247*b* are upper electrodes, the effects can also be achieved and the degree of freedom of the structure of the piezoelectric element 240 can be increased.

C. Third Embodiment

Figure 11:
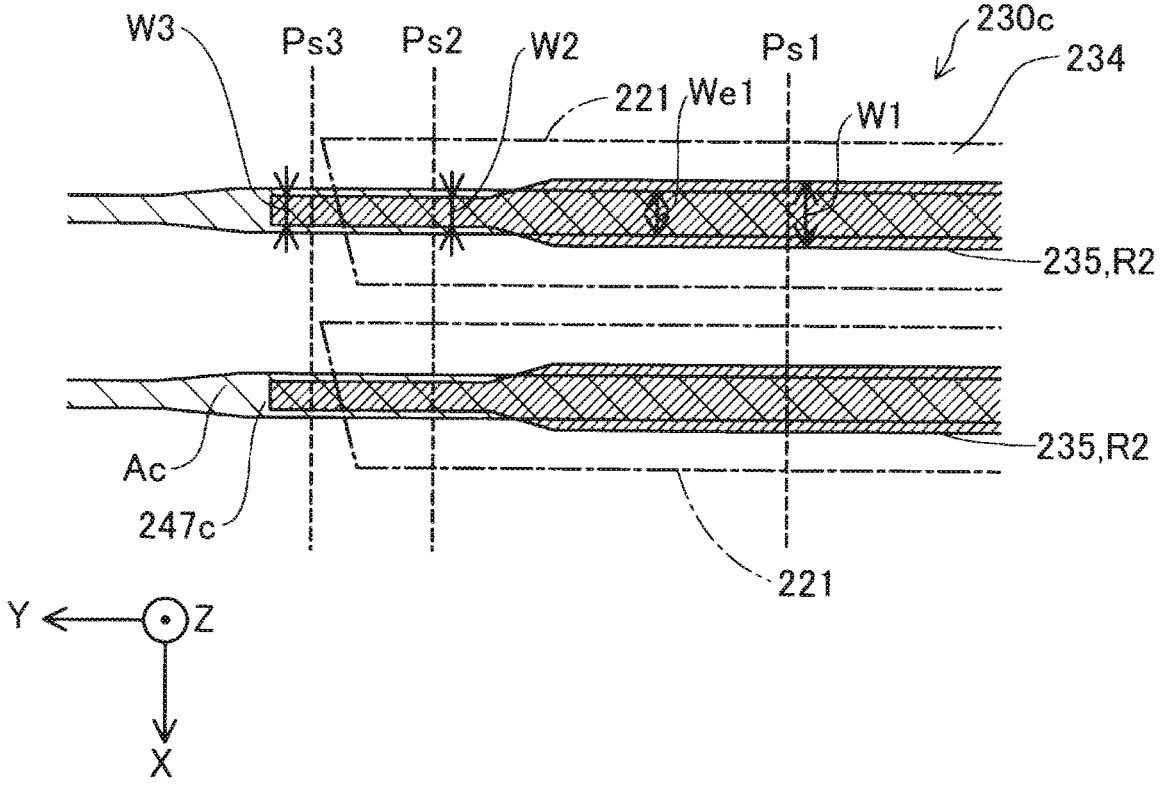
FIG. 11 illustrates a schematic structure of a piezoelectric section according to a third embodiment.

FIG. 11 illustrates a schematic structure of a piezoelectric section 230*c* according to a third embodiment. This embodiment is different from the first embodiment in that a width We1 of a second electrode 247*c* in the X direction in the first position Ps1 is less than the first width W1 of the vibrating plate 231. In FIG. 11, portions that correspond to the second portions 235 are hatched by lines sloping upward to the right, and portions that correspond to the second electrode 247*c* are hatched by lines sloping downward to the right. In FIG. 11, portions that are hatched by both lines correspond to portions where the second portions 235 are disposed and the second electrodes 247*c* are disposed. It should be noted that components that are not particularly mentioned in the liquid discharge apparatus 100 and the liquid discharge head 200 according to the third embodiment are similar to those in the first embodiment.

The second electrode 247*c* according to the embodiment has the width We1 also in the first position Ps1 and the third position Ps1. The width We1 is greater than the second width W2 and the third width W3.

As illustrated in FIG. 11, the second electrode 247 has the width We1 that is less than the first width W1 of the second portion 235, and in the first position Ps1, there is a boundary of an area inside the active area Ac and an area outside the active area Ac in a region between the second portion 235 and the first portion 234. Accordingly, in the first position Ps1, the deformation of the vibrating plate 231 is not interrupted in the region near the end of the second portion 235, and the piezoelectric element 240 can effectively deform the vibrating plate 231 in the first position Ps1.

In the liquid discharge head 200 according to the third embodiment, in the first direction, with the step height St between the region close to an end and the central portion away from the end in the vibrating plate 231, damage to the vibrating plate 231 and the piezoelectric element 240 in the region near the end of the pressure chamber 221 in the second direction can be suppressed. In particular, in this embodiment, the amount of change in volume in the pressure chamber 221 in the first position Ps1 can be increased, and thus the liquid discharge efficiency of the liquid discharge head 200 can be increased.

D. Fourth Embodiment

Figure 12:
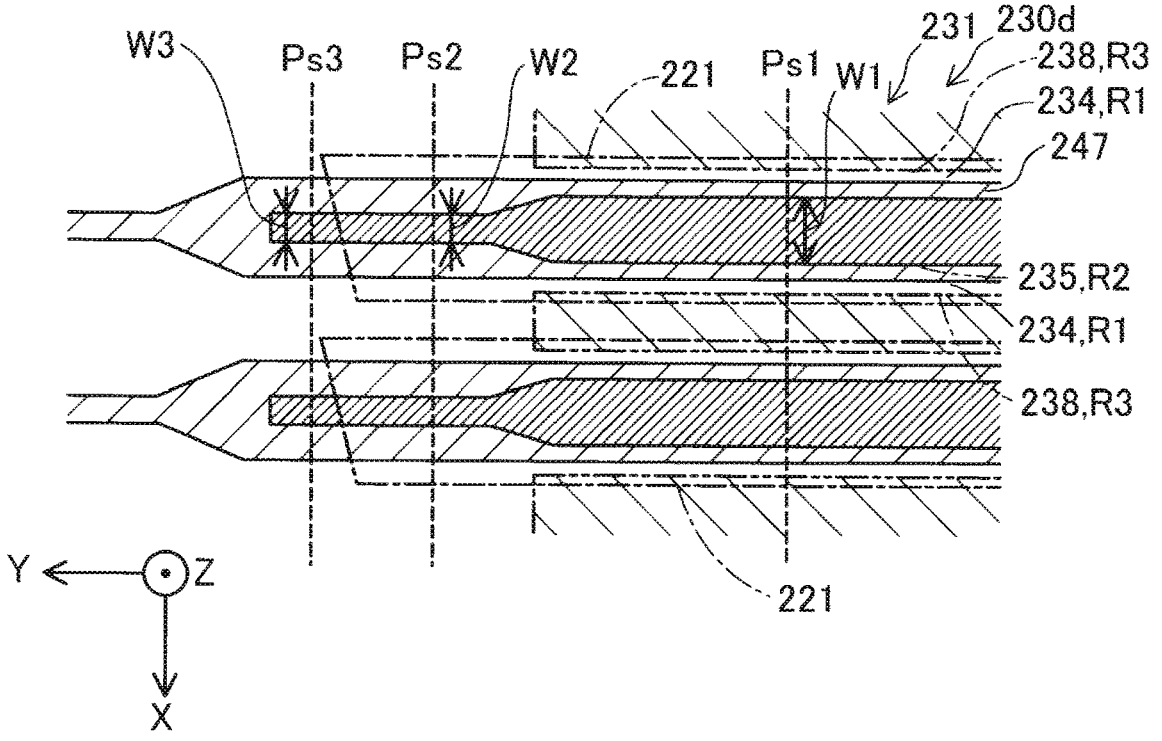
FIG. 12 illustrates a schematic structure of a piezoelectric section according to a fourth embodiment.

FIG. 12 illustrates a schematic structure of a piezoelectric section 230*d* according to a fourth embodiment. The vibrating plate 231 according to the embodiment is different from that in the first embodiment in that, in the first position Ps1, the vibrating plate 231 has a third portion 238 that is away from the second portion 235 in the X direction beyond the first portion 234. In the XY plane, a piezoelectric material 245*d* is not disposed in an area that overlaps the third portion 238. In FIG. 12, portions in the piezoelectric section 230*d* that correspond to the third portions 238 are hatched by chain double-dashed lines sloping downward to the right. It should be noted that components that are not particularly mentioned in the liquid discharge apparatus 100 and the liquid discharge head 200 according to the fourth embodiment are similar to those in the first embodiment.

Figure 13:
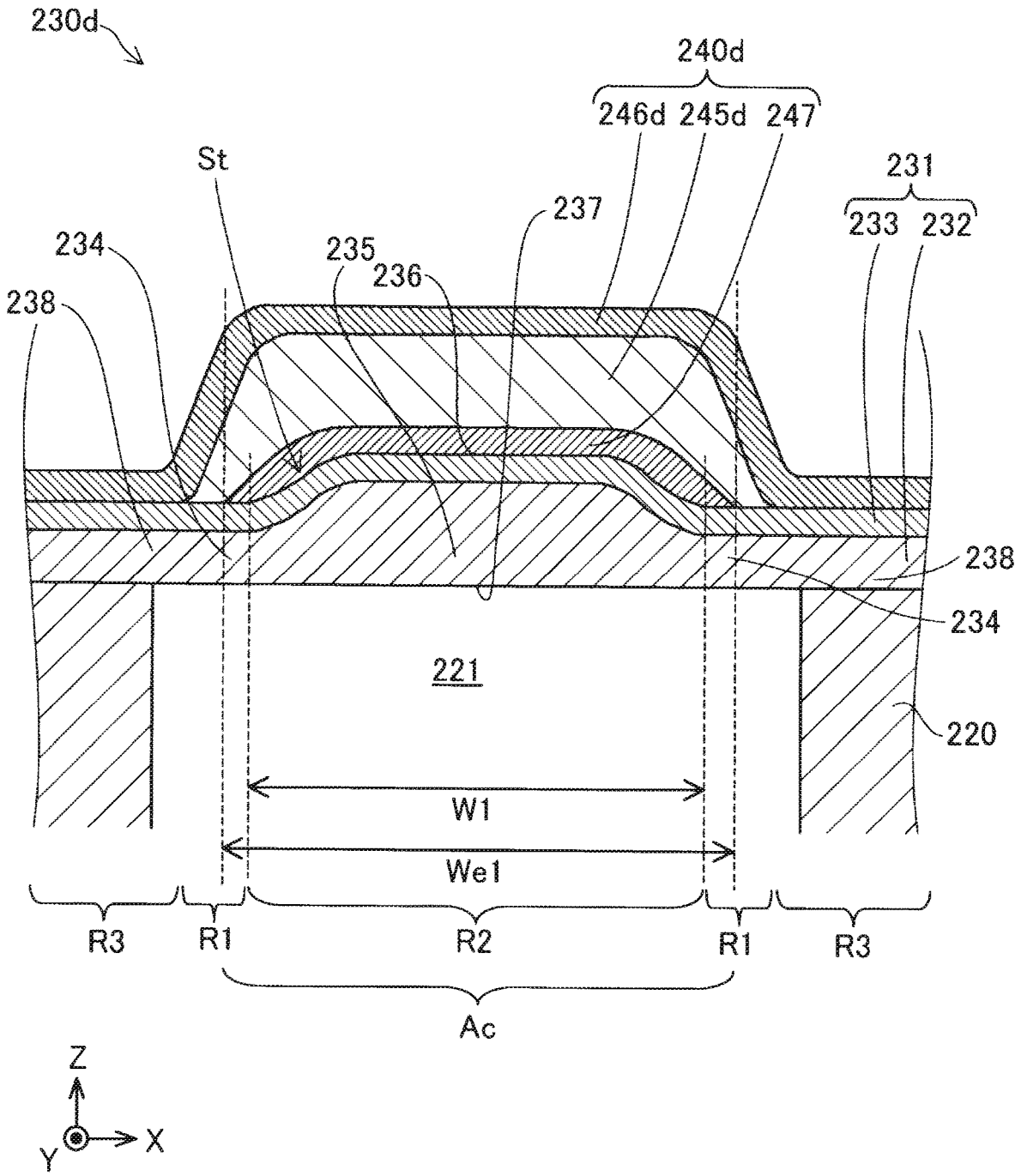
FIG. 13 is a cross-sectional view of the piezoelectric section and a pressure chamber plate at a first position according to the fourth embodiment.

FIG. 13 is a cross-sectional view of the piezoelectric section 230*d* and the pressure chamber plate 220 in the first position Ps1. As described above, in the first position Ps1, the vibrating plate 231 according to the embodiment has the third portion 238 that is away from the second portion 235 in the X direction beyond the first portion 234. As illustrated in FIG. 12 and FIG. 13, in the XY plane, an area that corresponds to the third portion 238 may be referred to as a third area R3. In addition, as illustrated in FIG. 12, the vibrating plate 231 does not have the third portion 238 in the second position Ps2.

As illustrated in FIG. 13, in this embodiment, in the first position Ps1, a first electrode 246*d* is provided but the piezoelectric material 245*d* is not provided in the third area R3. It should be noted that a piezoelectric element 240*d* according to the embodiment may be formed, for example, by removing the piezoelectric material 245*d* in the third area R3 by etching and then stacking the first electrode 246*d*.

The vibration plate 231 according to the embodiment may have the third portion 238 at least in the first position Ps1. Accordingly, the vibrating plate 231 may have the third portion 238, for example, also in the second position Ps2 and the third position Ps1.

In the liquid discharge head 200 according to the fourth embodiment, in the first direction, with the step height St between the region close to an end and the central portion away from the end in the vibrating plate 231, damage to the vibrating plate 231 and the piezoelectric element 240*d* in the region near the end of the pressure chamber 221 in the second direction can be suppressed. In particular, the vibration plate 231 according to the embodiment may have the third portion 238 at least in the first position Ps1, and in the first direction and the second direction, the piezoelectric material 245*d* is not provided in the area overlaps the third portion 238. Accordingly, in the region near the end of the pressure chamber 221 in the first direction in the first position Ps1, the deformation of the vibrating plate 231 is less likely to be inhibited by the piezoelectric material 245*d*, and thus the amount of change in volume in the pressure chamber 221 can be increased, and the liquid discharge efficiency of the liquid discharge head 200 can be increased.

E. Fifth Embodiment

Figure 14:
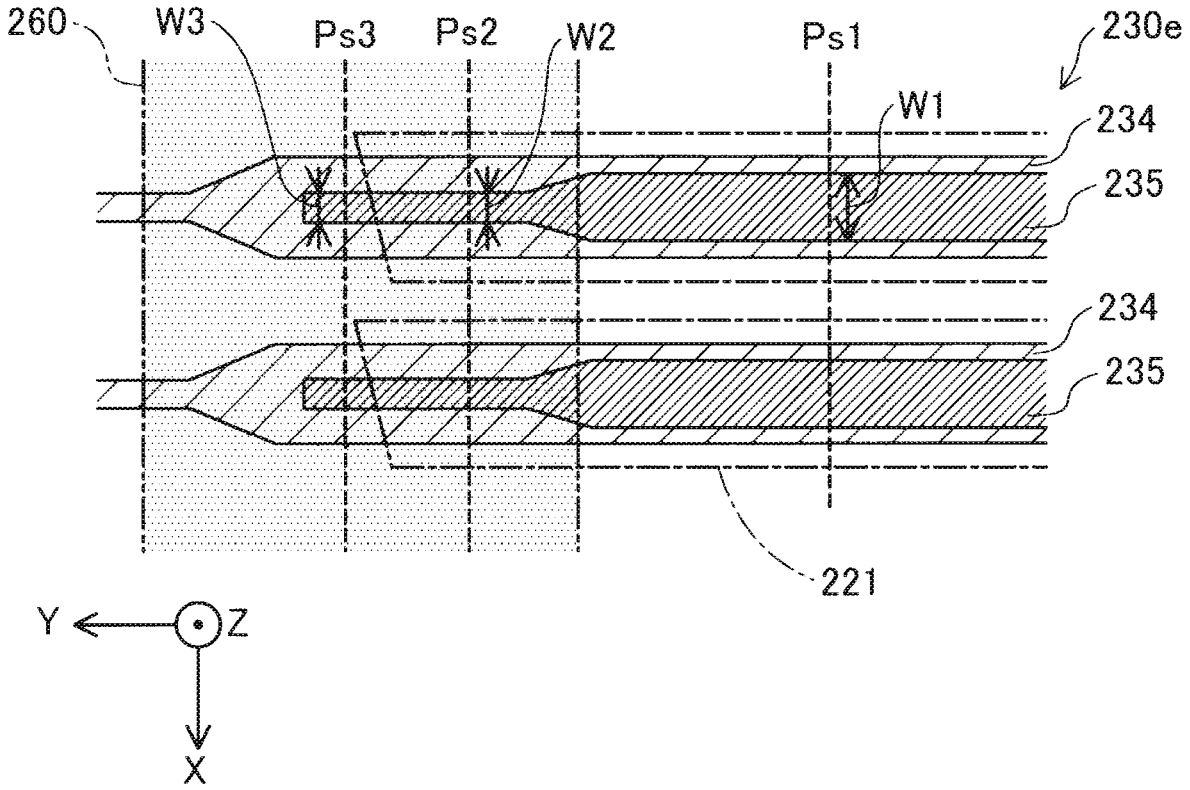
FIG. 14 illustrates a schematic structure of a piezoelectric section according to a fifth embodiment.

FIG. 14 illustrates a schematic structure of a piezoelectric section 230*e* according to a fifth embodiment. The piezoelectric section 230*e* according to the embodiment is different from the first embodiment in that the piezoelectric section 230*e* has a metal layer 260 that is stacked on the piezoelectric element 240. In FIG. 14, the metal layer 260 that is disposed in the piezoelectric section 230*e* is depicted by chain double-dashed lines in a halftone dot hatch pattern. It should be noted that components that are not particularly described in the liquid discharge apparatus 100 and the liquid discharge head 200 according to the fifth embodiment are similar to those in the first embodiment.

The metal layer 260 according to the embodiment is stacked on the first electrode 246. The metal layer 260 is made of, for example, gold (Au). The metal layer 260 is formed, for example, together with the lead electrodes 280 illustrated in FIG. 2 and FIG. 3. In such a case, for example, the metal layer 260 and the lead electrodes 280 may be formed by forming an Au thin film by sputtering, vacuum vapor deposition, or CVD, and then removing part of the Au thin film by etching or other methods. The metal layer 260 may be stacked on the first electrode 246, for example, with an adhesion layer therebetween. In such a case, the adhesion layer is formed of a metal, for example, titanium, nickel, or chromium, or an alloy of titanium, nickel, or chromium.

As illustrated in FIG. 14, in the X direction and the Y direction, the metal layer 260 extends outside the area where the pressure chambers 221 extend. More specifically, in the X direction and the Y direction, the metal layer 260 extends from inside the area where the pressure chambers 221 extend to the outside the area where the pressure chambers 221 extend. In addition, in the Y direction, the metal layer 260 overlaps portions of the second portions 235 that have widths less than the first width W1. In the Y direction, the metal layer 260 is disposed to overlap the regions between the first portions 234 and the second portions 235, and accordingly, in the regions between the first portions 234 and the second portions 235, the metal layer 260 can suppress excessive deformation of the vibrating plate 231.

In the liquid discharge head 200 according to the fifth embodiment, in the first direction, with the step height St between the region close to an end and the central portion away from the end in the vibrating plate 231, damage to the vibrating plate 231 and the piezoelectric element 240 in the region near the end of the pressure chamber 221 in the second direction can be suppressed. In particular, in this embodiment, in the second direction, the metal layer 260 is disposed to overlap the regions between the first portions 234 and the second portions 235, and accordingly, in the regions between the first portions 234 and the second portions 235, the metal layer 260 can suppress excessive deformation of the vibrating plate 231.

F. Sixth Embodiment

Figure 15:
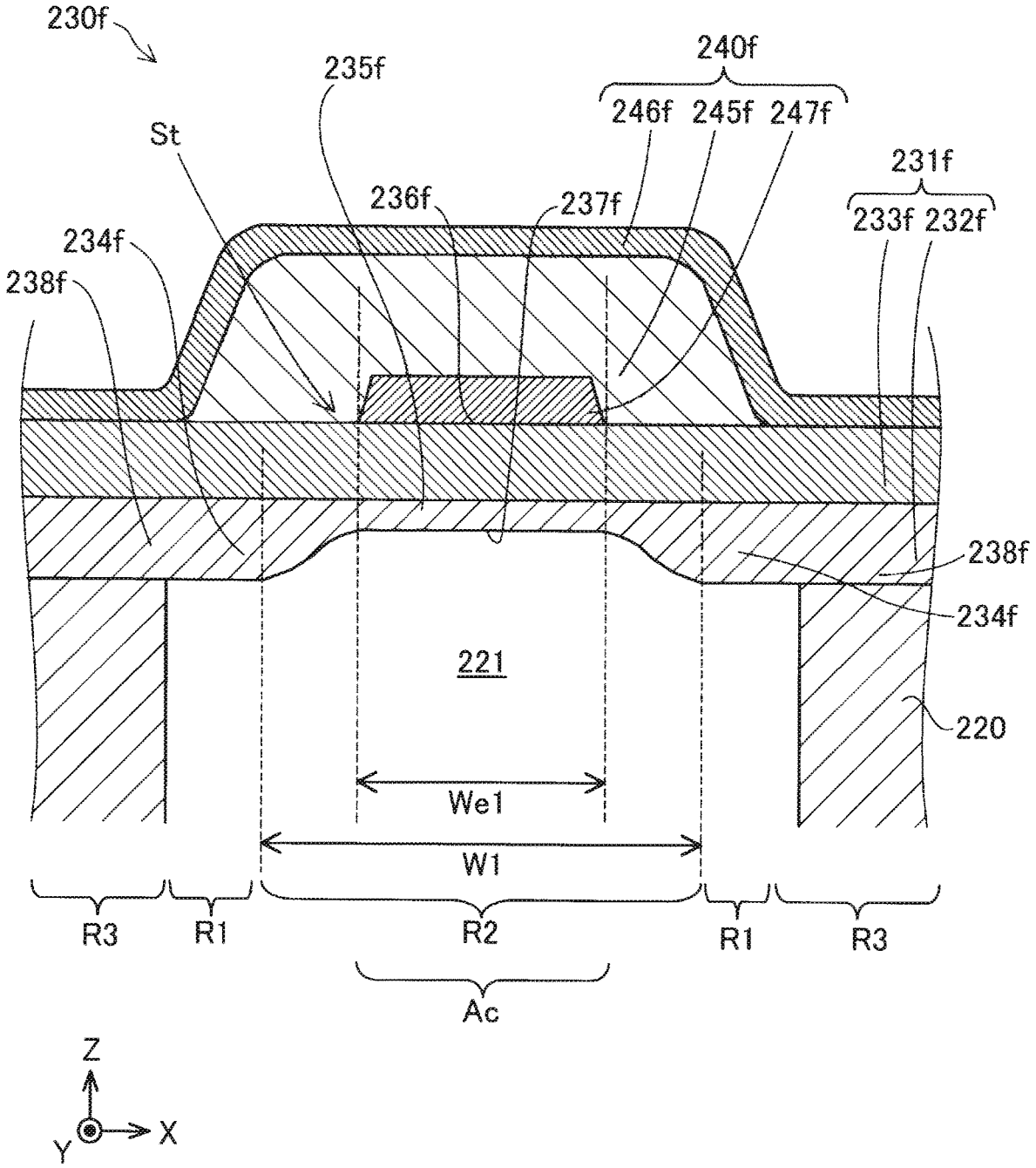
FIG. 15 is a cross-sectional view of a piezoelectric section and a pressure chamber plate at a first position according to a sixth embodiment.
Figure 16:
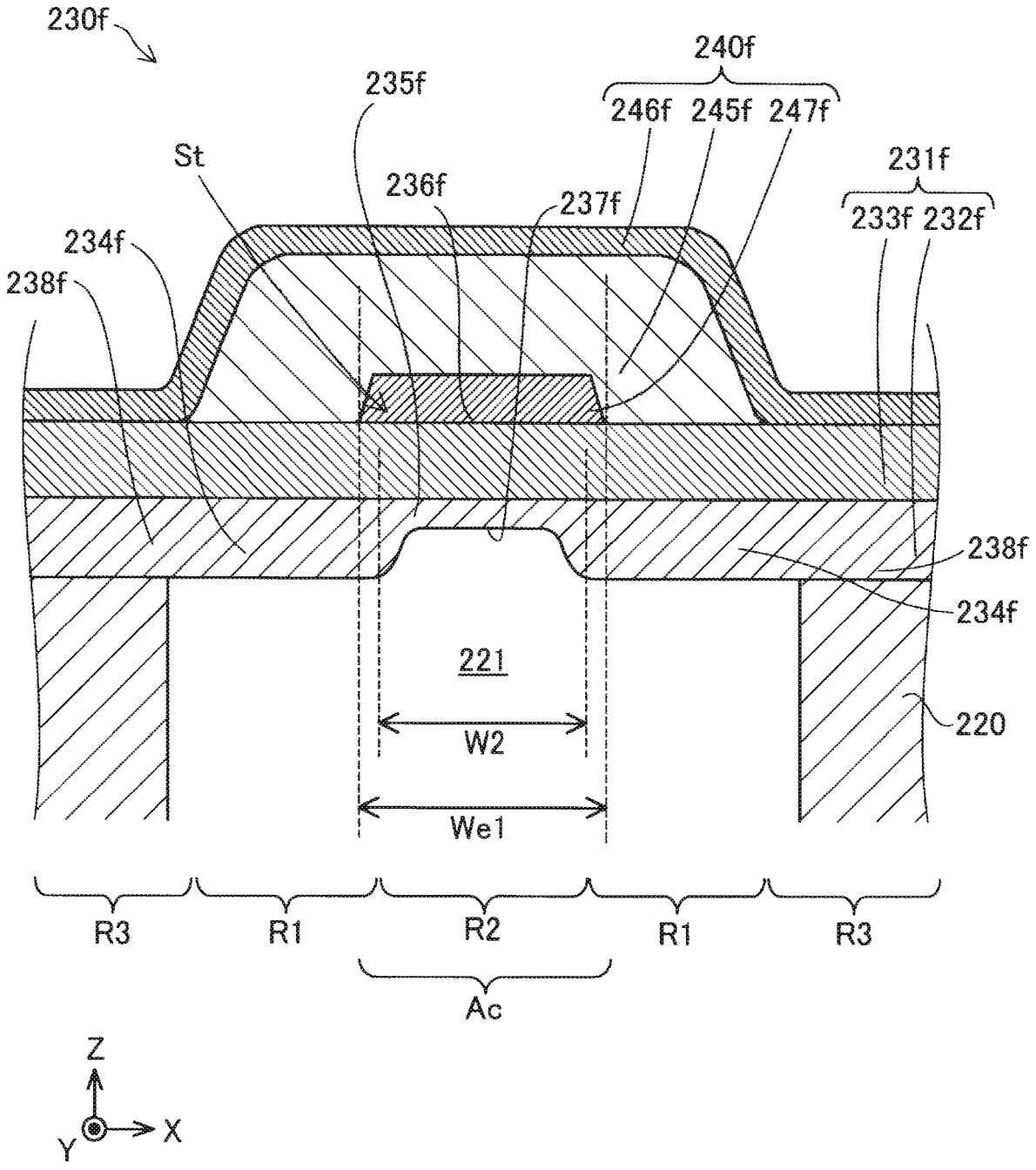
FIG. 16 is a cross-sectional view of a piezoelectric section and a pressure chamber plate at a second position according to the sixth embodiment.

FIG. 15 is a cross-sectional view of a piezoelectric section 230*f* and the pressure chamber plate 220 according to a sixth embodiment in the first position Ps1. FIG. 16 is a cross-sectional view of the piezoelectric section 230*f* and the pressure chamber plate 220 according to the sixth embodiment in the second position Ps2. In this embodiment, different from the first embodiment, the thickness of a second portion 235*f* of a vibrating plate 231*f* is less than the thickness of a first portion 234*f*. It should be noted that components that are not particularly described in the liquid discharge apparatus 100 and the liquid discharge head 200 according to the sixth embodiment are similar to those in the first embodiment.

As illustrated in FIG. 15, in this embodiment, in the first position Ps1, a width We1 of a second electrode 247*f* of a piezoelectric element 240*f* is less than a first width W1 of the second portion 235*f* similarly to the third embodiment. The second electrode 247*f* has the width We1 also in the first position Ps1 and the third position Ps1. In addition, the vibrating plate 231*f* has a third portion 238*f* similarly to the fourth embodiment. In the XY plane, in an area that overlaps the third portion 238*f*, a piezoelectric material 245*f* is not disposed but a first electrode 246*f* is disposed. It should be noted that the vibration plate 231*f* may not have the third portion 238*f* in other embodiments.

As illustrated in FIG. 15 and FIG. 16, a second width W2 of the second portion 235*f* according to the embodiment is less than the first width W1 similarly to the first embodiment.

As described above, the thickness of the second portion 235*f* according to the embodiment is less than the thickness of the first portion 234*f*. As illustrated in FIG. 15, the second portion 235*f* of the vibrating plate 231*f* according to the embodiment is recessed in the +Z direction. The position of a first surface 236*f* in the second portion 235*f* is the same as the position of the first surface 236*f* in the first portion 234*f* in the Z direction, which is the thickness direction of the vibrating plate 231. On the other hand, a second surface 237*f* in the second portion 235*f* is opposite to the second pressure chamber 221 in the Z direction with respect to the second surface 237*f* in the first portion 234*f*. In this embodiment, the first surface 236*f* is a protective layer 233*f*, and the second surface 237*f* is a flexible layer 232*f* similarly to the first embodiment.

In this embodiment, the thickness of the first portion 234*f* is greater than the thickness of the second portion 235*f*, and accordingly, in the first position Ps1 and the second position Ps2, damage to the vibrating plate 231*f* in the region near the end of the pressure chamber 221 in the X direction can be suppressed.

In the liquid discharge head 200 according to the fifth embodiment, in the first direction, with the step height St between the region close to an end and the central portion away from the end in the vibrating plate 231*f*, damage to the vibrating plate 231*f* and the piezoelectric element 240*f* in the region near the end of the pressure chamber 221 in the second direction can be suppressed.

G. Other Embodiments

G-1 In the above-described embodiments, the second portion 235 extends to the third position Ps3 that is outside the area where the pressure chamber 221 extends in the second direction. The second portion 235, however, may not extend to the third position Ps3 in the second direction. For example, the second portion 235 may extend to the second position Ps2 in the second direction and may not extend to the third position Ps3.

G-2 In the above-described embodiments, the width We2 of the second electrode 247 in the first direction in the second position Ps2 is greater than the second width W2 of the second portion 235 in the second position Ps2. The width We2, however, may be less than the second width W2 or may be equal to the second width W2.

G-3 In the third embodiment to the sixth embodiment, the second electrode 247 is disposed between the piezoelectric material 245 and the vibrating plate 231, and the first electrode 246 is disposed above the second electrode 247 with the piezoelectric material 245 disposed therebetween. In the third embodiment to the sixth embodiment, however, similarly to the second embodiment, the first electrode 246 may be disposed between the piezoelectric material 245 and the vibrating plate 231, and the second electrode 247 may be disposed above the first electrode 246 with the piezoelectric material 245 disposed therebetween. In an embodiment similar to the second embodiment, in addition, similarly to the fifth embodiment, a protective film or the like may be provided on the first electrode 246 when the piezoelectric material 245 is not provided in the third area R3.

H. Other Embodiments

The present disclosure is not limited to the above-described embodiments, and various modifications may be made without departing from the scope of the present disclosure. For example, the present disclosure may be implemented according to the following embodiments. The technical features in the above-described embodiments corresponding to the following embodiments may be replaced or combined as appropriate to solve some or all of the above-described problems or to achieve some or all of the above-described effects. Unless the technical features are described as essential in this specification, the technical features may be omitted as appropriate.

1. According to a first aspect of the present disclosure, a liquid discharge head that includes piezoelectric elements, a pressure chamber plate defining pressure chambers corresponding to the piezoelectric elements, and a vibrating plate disposed between the piezoelectric elements and the pressure chamber plate is provided. In the liquid discharge head, when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion. In the first position, a width of the second portion in the first direction is a first width, and in the second position, a width of the second portion in the first direction is a second width that is less than the first width. According to the aspect, in the first direction, a step height between a region close to an end and a central portion away from the end in the vibrating plate can achieve an effect of the step height of the vibrating plate also in a region near the end of the pressure chamber in the second direction, and thus damage to the vibrating plate and the piezoelectric element in the region near the end of the pressure chamber in the second direction can be suppressed.

2. In the liquid discharge head according to the aspect, the first portion and the second portion may extend to a third position that is outside an area where the pressure chambers extend in the second direction, and in the third position, the width of the second portion in the first direction may be less than or equal to the second width. According to the aspect, the effect of the step height of the vibrating plate can be achieved also in the region near the end of the pressure chamber in the second direction, and thus damage to the vibrating plate and the piezoelectric element in the region near the end of the pressure chamber in the second direction can be suppressed.

3. In the liquid discharge head according to the aspect, a thickness of the second portion may be greater than a thickness of the first portion. According to the aspect, in the first portion the durability of the vibrating plate can be increased, and in the portion of the pressure chamber that corresponds to the second portion, the amount of change in volume in the pressure chamber can be increased, and thus the liquid discharge efficiency of the liquid discharge head can be increased.

4. In the liquid discharge head according to the aspect, the vibrating plate may have a first surface that is away from the pressure chamber in the thickness direction and a second surface that is opposite to the first surface, in the thickness direction, the first surface in the second portion may be opposite to the pressure chamber with respect to the first surface in the first portion, and in the thickness direction, a position of the second surface in the first portion may be the same as a position of the second surface in the second portion. According to the aspect, with the simple structure, the second portion can have a thickness greater than that of the first portion.

5. In the liquid discharge head according to the aspect, a thickness of the second portion may be less than a thickness of the first portion. According to the aspect, in a case in which a thickness of the second portion is less than a thickness of the first portion, damage to the vibrating plate and the piezoelectric element in the region near the end of the pressure chamber in the second direction can be suppressed.

6. In the liquid discharge head according to the aspect, the vibrating plate may have a first surface that is away from the pressure chamber in the thickness direction and a second surface that is opposite to the first surface, in the thickness direction, a position of the first surface in the first portion may be the same as a position of the second surface in the second portion, and in the thickness direction, the second surface in the second portion may be opposite to the pressure chamber with respect to the second surface in the first portion. According to the aspect, with the simple structure, the second portion can have a thickness less than that of the first portion.

7. In the liquid discharge head according to the aspect, the piezoelectric elements may be a laminate of a piezoelectric material, a first electrode, and second electrodes, the first electrode may be a common electrode for the pressure chambers, and the second electrodes may be individually provided for the pressure chambers.

8. In the liquid discharge head according to the aspect, the first electrode may be disposed between the piezoelectric material and the vibrating plate, and the second electrodes may be disposed above the first electrode with the piezoelectric material disposed therebetween. According to the aspect, in a structure in which the first electrode is a lower electrode and the second electrodes are upper electrodes, damage to the vibrating plate and the piezoelectric element in the region near the end of the pressure chamber in the second direction can be suppressed. Consequently, the degree of freedom of the structure of the piezoelectric element can be increased.

9. In the liquid discharge head according to the aspect, the second electrodes may be disposed between the piezoelectric material and the vibrating plate, and the first electrode may be disposed above the second electrodes with the piezoelectric material disposed therebetween. According to the aspect, in a structure in which the first electrode is an upper electrode and the second electrodes are lower electrodes, damage to the vibrating plate and the piezoelectric element in the region near the end of the pressure chamber in the second direction can be suppressed. Consequently, the degree of freedom of the structure of the piezoelectric element can be increased.

10. In the liquid discharge head according to the aspect, the width of the second electrode in the first direction in the second position may be greater than the second width. According to the aspect, in the second position, the second electrode overlaps the portion that corresponds to the region between the first portion and the second portion, and thus damage to the vibrating plate and the piezoelectric element in the portion corresponding to the region between the first portion and the second portion can be suppressed.

11. In the liquid discharge head according to the aspect, the second electrode may cover the second portion in the second position. According to the aspect, in the second position, in the second position, the region between the first portion and the second portion is directly supported by the second electrode, and thus damage to the vibrating plate and the piezoelectric element in the portion that corresponds to the region between the first portion and the second portion can be suppressed.

12. In the liquid discharge head according to the aspect, the width of the second electrode in the first direction in the first position may be less than the first width. According to the aspect, the amount of change in volume in the pressure chamber in the first position can be increased, and thus the liquid discharge efficiency of the liquid discharge head can be increased.

13. In the liquid discharge head according to the aspect, the vibrating plate may have a third portion that is away from the second portion in the first direction beyond the first portion at least in the first position, and the piezoelectric material may not be provided in an area that overlaps the third portion in the first direction and the second direction. According to the aspect, in the region near the end of the pressure chamber in the first direction in the first position, the deformation of the vibrating plate is less likely to be inhibited by the piezoelectric material, and thus the amount of change in volume in the pressure chamber can be increased, and the liquid discharge efficiency of the liquid discharge head can be increased.

14. In the liquid discharge head according to the aspect, the liquid discharge head may include a metal layer stacked on the piezoelectric elements, and the metal layer may overlap portions of the second portions that have widths less than the first width of the second portion in the first direction and the second direction and may extend outside the area where the pressure chambers extend. According to the aspect, in the second direction, a metal layer is disposed to overlap the regions between the first portions and the second portions, and accordingly, in the regions between the first portions and the second portions, the metal layer can suppress excessive deformation of the vibrating plate.

15. According to a second aspect of the present disclosure, a liquid discharge apparatus is provided. The liquid discharge apparatus includes the liquid discharge head according to the first aspect, and a controller configured to control the discharge operation of the liquid discharge head. According to the aspect, in each of the piezoelectric elements, in the region near the end of the pressure chamber in the second direction, in the first direction, a step height between a region close to an end and a central portion away from the end in the vibrating plate can achieve the effect of the step height of the vibrating plate also in the region near the end of the pressure chamber in the second direction, and thus damage to the vibrating plate and the piezoelectric element in the region near the end of the pressure chamber in the second direction can be suppressed.

16. According to a third aspect of the present disclosure, an actuator that includes piezoelectric elements, and a vibrating plate disposed between pressure chambers corresponding to the piezoelectric elements and the piezoelectric elements is provided. In the actuator, when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion. In the first position, a width of the second portion in the first direction is a first width, and in the second position, a width of the second portion in the first direction is a second width that is less than the first width. According to the aspect, in the first direction, the step height between a region close to an end and a central portion away from the end in the vibrating plate can achieve the effect of the step height of the vibrating plate also in the region near the end of the pressure chamber in the second direction, and thus damage to the vibrating plate and the piezoelectric element in the region near the end of the pressure chamber in the second direction can be suppressed.

The present disclosure is not limited to the liquid discharge head, the liquid discharge apparatus, and the actuator, but may be implemented in various embodiments such as liquid discharge systems and multifunction peripherals that have the liquid discharge apparatus.

What is claimed is:

1. A liquid discharge head comprising:

piezoelectric elements;

a pressure chamber plate defining pressure chambers corresponding to the piezoelectric elements; and a vibrating plate disposed between the piezoelectric elements and the pressure chamber plate, wherein when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion, in the first position, a width of the second portion in the first direction is a first width, and in the second position, a width of the second portion in the first direction is a second width that is less than the first width.

2. The liquid discharge head according to claim 1, wherein the first portion and the second portion extend to a third position that is outside an area where the pressure chambers extend in the second direction, and in the third position, the width of the second portion in the first direction is less than or equal to the second width.

3. The liquid discharge head according to claim 1, wherein a thickness of the second portion is greater than a thickness of the first portion.

4. The liquid discharge head according to claim 3, wherein when a direction in which the intersects with the first direction and the second direction is a thickness direction, the vibrating plate has a first surface that is away from the pressure chamber in the thickness direction and a second surface that is opposite to the first surface, in the thickness direction, the first surface in the second portion is opposite to the pressure chamber with respect to the first surface in the first portion, and in the thickness direction, a position of the second surface in the first portion is the same as a position of the second surface in the second portion.

5. The liquid discharge head according to claim 1, wherein the thickness of the second portion is less than the thickness of the first portion.

6. The liquid discharge head according to claim 5, wherein when a direction in which the intersects with the first direction and the second direction is a thickness direction, the vibrating plate has a first surface that is away from the pressure chamber in the thickness direction and a second surface that is opposite to the first surface, in the thickness direction, a position of the first surface in the first portion is the same as a position of the second surface in the second portion, and in the thickness direction, the second surface in the second portion is opposite to the pressure chamber with respect to the second surface in the first portion.

7. The liquid discharge head according to claim 1, wherein the piezoelectric elements are a laminate of a piezoelectric material, a first electrode, and second electrodes, the first electrode is a common electrode for the pressure chambers, and the second electrodes are individually provided for the pressure chambers.

8. The liquid discharge head according to claim 7, wherein the first electrode is disposed between the piezoelectric material and the vibrating plate, and the second electrodes are disposed above the first electrode with the piezoelectric material disposed therebetween.

9. The liquid discharge head according to claim 7, wherein the second electrodes are disposed between the piezoelectric material and the vibrating plate, and the first electrode is disposed above the second electrodes with the piezoelectric material disposed therebetween.

10. The liquid discharge head according to claim 7, wherein the width of the second electrode in the first direction in the second position is greater than the second width.

11. The liquid discharge head according to claim 10, wherein the second electrode covers the second portion in the second position.

12. The liquid discharge head according to claim 7, wherein the width of the second electrode in the first direction in the first position is less than the first width.

13. The liquid discharge head according to claim 7, wherein the vibrating plate has a third portion that is away from the second portion in the first direction beyond the first portion at least in the first position, and the piezoelectric material is not provided in an area that overlaps the third portion when viewed along a thickness direction which intersects with the first direction and the second direction.

14. The liquid discharge head according to claim 1, further comprising:

a metal layer stacked on the piezoelectric elements, wherein the metal layer overlaps portions of the second portions that have widths less than the first width of the second portion when viewed along a thickness direction which intersects with the first direction and the second direction, and the metal layer extends outside the area where the pressure chambers extend when viewed along the thickness direction.

15. A liquid discharge apparatus comprising:

the liquid discharge head according to claim 1, and a controller configured to control the discharge operation of the liquid discharge head.

16. An actuator comprising:

piezoelectric elements; and a vibrating plate disposed between pressure chambers corresponding to the piezoelectric elements and the piezoelectric elements, wherein when a direction in which the pressure chambers are arrayed is a first direction, a direction in which the individual pressure chambers extend is a second direction, a specific position in the pressure chambers in the second direction is a first position, and a specific position in the pressure chambers in the second direction, the position closer to an end of the pressure chamber than the first position in the second direction is a second position, the vibrating plate has, in the first position and the second position, a first portion and a second portion that is away from the end of the pressure chamber than the first portion in the first direction and has a thickness different from a thickness of the first portion, in the first position, a width of the second portion in the first direction is a first width, and in the second position, a width of the second portion in the first direction is a second width that is less than the first width.

* * * * *